US008911339B2

(12) United States Patent
De Paula et al.

(10) Patent No.: US 8,911,339 B2
(45) Date of Patent: Dec. 16, 2014

(54) COOLER CARTON WITH ZIPPER OPENING FEATURE

(75) Inventors: Andrea Coltri De Paula, Marietta, GA (US); Jean-Manuel Gomes, Marietta, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 182 days.

(21) Appl. No.: 13/368,856

(22) Filed: Feb. 8, 2012

(65) Prior Publication Data

US 2012/0131884 A1 May 31, 2012

Related U.S. Application Data

(62) Division of application No. 12/437,856, filed on May 8, 2009, now Pat. No. 8,136,717.

(60) Provisional application No. 61/137,865, filed on Aug. 4, 2008, provisional application No. 61/051,474, filed on May 8, 2008.

(51) Int. Cl.

| | |
|---|---|
| ***B31B 1/50*** | (2006.01) |
| ***B31B 1/62*** | (2006.01) |
| ***B65D 71/36*** | (2006.01) |
| ***B65D 5/40*** | (2006.01) |
| ***B65D 5/02*** | (2006.01) |
| ***B65D 5/54*** | (2006.01) |

(52) U.S. Cl.

CPC .... *B65D 5/0263* (2013.01); *B65D 2571/00574* (2013.01); *B65D 71/36* (2013.01); *B65D 2571/00141* (2013.01); *B65D 5/40* (2013.01); *B65D 2571/00728* (2013.01); *B65D 5/5415* (2013.01); *B65D 2571/00635* (2013.01); *B65D 2571/0066* (2013.01); *B65D 2571/00567* (2013.01)

USPC ..... 493/128; 229/101; 229/227; 229/240; 229/242; 493/183

(58) Field of Classification Search

USPC ..... 229/101, 227, 240, 241, 242, 924, 925, 229/926; 206/427; 493/128, 130, 131, 132, 493/162, 183; 53/458, 467

See application file for complete search history.

(56) References Cited

U.S. PATENT DOCUMENTS 2,810,506 A 10/1957 Kessler
2,868,433 A 1/1959 Anderson, Jr.

(Continued)

FOREIGN PATENT DOCUMENTS

DE 20 2004 018 649 U1 4/2005
EP 0 412 226 2/1991

(Continued)

OTHER PUBLICATIONS

Office Action dated Nov. 23, 2012 in U.S. Appl. No. 13/048,917.

(Continued)

*Primary Examiner* — Gary Elkins
(74) *Attorney, Agent, or Firm* — Womble Carlyle Sandridge & Rice, LLP

(57) ABSTRACT

A paperboard carton doubles as a shipping container for articles such as beverage cans and a cooler for containing ice to cool the articles when the carton is opened. The top portion of the carton is breached by removing an opening strip defined by zipper rules. Once breached, the tops and side panels of the carton are opened up to form an upwardly open chimney or skirt into which ice can be placed to cool the contents of the carton. Gussets formed in the lower corners of the cartons insure that water from melting ice does not leak prematurely from the carton.

12 Claims, 32 Drawing Sheets

(56) References Cited

U.S. PATENT DOCUMENTS

| | | | |
|---|---|---|---|
| 2,919,060 | A | 12/1959 | Daniels |
| 2,929,060 | A | 12/1959 | Daniels |
| 2,955,739 | A | 10/1960 | Collura |
| 3,112,856 | A | 12/1963 | MacIntosh et al. |
| 3,346,399 | A | 10/1967 | Watson |
| 3,355,089 | A | 11/1967 | Champlin |
| 3,886,901 | A | 6/1975 | Zeitter |
| 4,036,423 | A | 7/1977 | Gordon |
| 4,328,923 | A | 5/1982 | Graser |
| 4,331,289 | A | 5/1982 | Killy |
| 4,378,905 | A | 4/1983 | Roccaforte |
| 4,498,581 | A | 2/1985 | Dutcher |
| 4,498,619 | A | 2/1985 | Roccaforte |
| 4,546,914 | A | 10/1985 | Roccaforte |
| 4,577,799 | A | 3/1986 | Oliff |
| 4,588,084 | A | 5/1986 | Holley, Jr. |
| 4,703,855 | A | 11/1987 | Moe et al. |
| 4,979,666 | A | 12/1990 | Zion et al. |
| 5,007,541 | A | 4/1991 | Gunn et al. |
| 5,020,337 | A | 6/1991 | Krieg |
| 5,161,734 | A | 11/1992 | Ruehl et al. |
| 5,249,681 | A | 10/1993 | Miller |
| 5,292,058 | A | 3/1994 | Zoss et al. |
| 5,303,863 | A | 4/1994 | Arasim |
| 5,320,277 | A | 6/1994 | Stout et al. |
| 5,379,944 | A | 1/1995 | Stout et al. |
| 5,385,234 | A | 1/1995 | Stout et al. |
| 5,472,090 | A | 12/1995 | Sutherland |
| 5,472,136 | A | 12/1995 | Roccaforte |
| 5,495,727 | A | 3/1996 | Strong et al. |
| 5,505,372 | A | 4/1996 | Edson et al. |
| 5,551,566 | A | 9/1996 | Sutherland |
| 5,582,343 | A | 12/1996 | Dalvey |
| 5,595,292 | A | 1/1997 | Bates |
| 5,639,017 | A | 6/1997 | Fogle |
| 5,794,778 | A | 8/1998 | Harris |
| 5,826,782 | A | 10/1998 | Stout |
| 5,873,515 | A | 2/1999 | Dunn et al. |
| 5,915,546 | A | 6/1999 | Harrelson |
| 5,992,733 | A | 11/1999 | Gomes |
| 6,021,897 | A | 2/2000 | Sutherland |
| 6,065,590 | A | 5/2000 | Spivey |
| 6,112,977 | A | 9/2000 | Sutherland et al. |
| 6,164,526 | A | 12/2000 | Dalvey |
| 6,176,419 | B1 | 1/2001 | Holley, Jr. |
| 6,260,755 | B1 | 7/2001 | Bates et al. |
| 6,273,330 | B1 | 8/2001 | Oliff et al. |
| 6,302,320 | B1 | 10/2001 | Stout |
| 6,536,656 | B2 | 3/2003 | Auclair et al. |
| 6,554,159 | B1 | 4/2003 | Behr et al. |
| 6,676,013 | B2 | 1/2004 | Auclair |
| D490,703 | S | 6/2004 | Rusnock |
| 6,834,793 | B2 | 12/2004 | Sutherland |
| 6,869,009 | B2 | 3/2005 | Sutherland et al. |
| 6,926,193 | B2 | 8/2005 | Smalley |
| 6,945,450 | B2 | 9/2005 | Rusnock |
| 7,234,596 | B2 | 6/2007 | Lebras |
| 7,374,043 | B2 | 5/2008 | Holley, Jr. et al. |
| 7,380,701 | B2 | 6/2008 | Fogle et al. |
| 7,416,109 | B2 | 8/2008 | Sutherland |
| 7,467,713 | B2 | 12/2008 | Harrelson |
| 7,601,111 | B2 | 10/2009 | Sutherland et al. |
| 7,611,042 | B2 | 11/2009 | Bates et al. |
| 7,717,318 | B2 | 5/2010 | Brand |
| 7,727,318 | B2 | 6/2010 | Feng et al. |
| 7,743,944 | B2 | 6/2010 | Ho Fung et al. |
| 7,926,295 | B2 | 4/2011 | Brand |
| 8,136,717 | B2 * | 3/2012 | De Paula et al. ..... 229/101 |
| 2005/0167476 | A1 | 8/2005 | Ikeda |
| 2006/0032899 | A1 | 2/2006 | Bell |
| 2006/0081690 | A1 | 4/2006 | Bates et al. |
| 2006/0273143 | A1 | 12/2006 | Finch |
| 2007/0051781 | A1 | 3/2007 | Holley, Jr. |
| 2007/0164091 | A1 | 7/2007 | Fogle et al. |
| 2007/0181658 | A1 | 8/2007 | Sutherland |
| 2007/0284424 | A1 | 12/2007 | Holley |
| 2008/0083820 | A1 | 4/2008 | Walling et al. |
| 2008/0099544 | A1 | 5/2008 | Skolik |
| 2008/0119344 | A1 | 5/2008 | Sutherland et al. |
| 2009/0255983 | A1 | 10/2009 | De Paula et al. |
| 2009/0277954 | A1 | 11/2009 | De Paula et al. |
| 2011/0162408 | A1 | 7/2011 | Brand |

FOREIGN PATENT DOCUMENTS

| | | |
|---|---|---|
| EP | 2 121 456 | 11/2009 |
| FR | 1 494 239 | 9/1967 |
| FR | 2 579 175 | 9/1986 |
| JP | S54-73125 | 5/1979 |
| JP | 2000177727 | 6/2000 |
| JP | 2004292023 | 10/2004 |
| JP | 2006-298465 | 11/2006 |
| WO | WO 2006/119360 A1 | 11/2006 |
| WO | WO 2007/089282 | 8/2007 |
| WO | WO 2008/083413 A1 | 7/2008 |

OTHER PUBLICATIONS

International Search Report and Written Opinion—PCT/2009/043249.

Office Action issued in corresponding Japanese Application No. 2011-508697 on Jan. 8, 2013.

Office Action issued in corresponding Japanese Application No. 200980116421.8 on Jan. 14, 2013.

* cited by examiner

COOLER CARTON WITH ZIPPER OPENING FEATURE

CROSS-REFERENCE TO RELATED APPLICATIONS

The present application is a divisional of allowed U.S. patent application Ser. No. 12/437,856, filed May 8, 2009, which claims the benefit of each of Provisional Application No. 61/051,474, filed May 8, 2008, and Provisional Application No. 61/137,865, filed Aug. 4, 2008. The entire disclosures of all of the above-referenced patent applications are incorporated herein by reference.

BACKGROUND

The present disclosure generally relates to a carton for handling and carrying containers, and particularly to cartons having liquid-tight or leakage resistant features.

SUMMARY OF THE DISCLOSURE

According to one aspect, a carton comprises a first side panel, a bottom panel, a second side panel, a first end panel, a second end panel, and a plurality of gussets. One gusset is located at each corner of the bottom panel and is disposed between and foldably connected to an adjacent side panel and end panel so as to seal or close off the corners of the carton.

According to another aspect, a top panel can be opened and ice, cold water, additional containers, and/or other articles can be placed in the carton through the opened top end. The interior volume of the carton can be used to retain liquids, such as water resulting from melting ice, condensation, other liquids, and articles such as, for example, refuse, and particulate matter.

According to another aspect, a carton is provided that includes a first side panel, a second side panel, a top panel, a bottom panel, a first end panel, a second end panel, and a carton opening feature comprising at least one tear strip defined between a first tear line and a second tear line extending in the first end panel, in the top panel, and in the second end panel. Optionally, a first top panel end flap can be connected to the top panel along a first fold line and a first bottom panel end flap can be connected to the bottom panel along a second fold line. Optionally still, at least a portion of the first top panel end flap can be disposed over at least a portion of the first bottom panel end flap in the first end panel. Further, the at least one tear strip includes a first tear strip that extends in the first top panel end flap and not into the first bottom panel end flap. Further still, a second top panel end flap can be connected to the top panel along a third fold line, and a second bottom panel end flap can be connected to the bottom panel along a fourth fold line. Even further, at least a portion of the second top panel end flap can be disposed over at least a portion of the second bottom panel end flap in the second end panel, and the at least one tear strip includes a second tear strip that extends in the second top panel end flap and not into the second bottom panel end flap.

According to another aspect, a carton formed from a blank is provided. The carton includes a first side that comprises a first panel and a second panel, a second side, a third side, a fourth side, a fifth side, a sixth side, and a carton opening feature that comprises a first tear strip and a second tear strip separated by at least one finger flap. The first tear strip is defined between a first tear line and a second tear line, with the first tear line and the second tear line extending in the first side and in the fifth side. The second tear strip is defined between a third tear line and a fourth tear line, with the third tear line and the fourth tear line extending in the first side and in the sixth side. Optionally, the carton can enclose a plurality of cylindrical containers.

According to another aspect, a method of erecting a carton is provided. The method includes providing a carton blank having an upper side and an under side. The carton blank includes a first side panel, a bottom panel, and a second side panel foldably connected to the bottom panel at a first transverse fold line. A first top panel is foldably connected to the first side panel at a second transverse fold line and a second top panel is foldably connected to the second side panel. A first bottom end panel is at a first end of the bottom panel, a second bottom end panel is at a second end of the bottom panel, and at least one first top flap is foldably connected to a first end of the first top panel at a first longitudinal fold line. The at least one first top flap comprises a pair of first top flaps connected at a first oblique fold line and at least one second top flap foldably connected to a second end of the first top panel at a second longitudinal fold line. The at least one second top flap comprises a pair of second top flaps connected at a second oblique fold line and at least one third top flap foldably connected to a first end of the second top panel at a third longitudinal fold line. The at least one third top flap comprises a pair of third top flaps connected at a third oblique fold line, and at least one fourth top flap foldably connected to a first end of the second top panel at a fourth longitudinal fold line with the at least one fourth top flap comprising a pair of fourth top flaps connected at a fourth oblique fold line.

The method including folding the pair of first top flaps at the first oblique fold line and folding the pair of second top flaps at the second oblique fold line, folding the pair of third top flaps at the third oblique fold line and folding the pair of fourth top flaps at the fourth oblique fold line, folding the first top panel with respect to the first side panel about the second transverse fold line, and folding the second side panel with respect to the bottom panel about the first transverse fold line. Optionally, after folding the second side panel about the first transverse fold line, the method can include gluing the blank to form a tubular structure, and, forming a top panel from the first top panel and the second top panel. Optionally still, gluing the blank to form a tubular structure can comprise adhering the first top panel to the second top panel, adhering the pair of first top flaps to the pair of third top flaps, and adhering the pair of second top flaps to the pair of fourth top flaps. Further, the method can include folding the at least one first top flap and the at least third top flap with respect to the top panel about the first longitudinal fold line and the third longitudinal fold line. Further still, the carton blank can comprise at least one first side panel flap foldably connected to a first end of the first side panel at a fifth longitudinal fold line, at least one second side panel flap foldably connected to a second end of the first side panel at a sixth longitudinal fold line, at least one third side panel flap foldably connected to a first end of the second side panel at a seventh longitudinal fold line, at least one fourth side panel flap foldably connected to a second end of the second side panel at an eighth longitudinal fold line, the first bottom panel foldably connected to the bottom panel along a ninth longitudinal fold line, and the second bottom panel foldably connected to the bottom panel along a tenth longitudinal fold line. Even further, the method can include folding the at least one first side panel flap with respect to the first side panel about the fifth longitudinal fold line and folding the at least one third side panel flap with respect to the second side panel about the seventh longitudinal fold line. Even further still, the at least one first side panel flap can comprise a pair of first side panel flaps connected at a fifth oblique fold line and the at least one third side panel end flap can comprise a pair of third side panel flaps connected at a sixth oblique fold line.

The method can include folding one of the pair of first side panel flaps about the fifth oblique fold line and folding one of the pair of third side panel end flaps about the seventh oblique fold line. Also, the method can comprise folding the first bottom end panel with respect to the bottom panel along the ninth longitudinal fold line, and gluing the first bottom end panel to the at least one first top flap and to the at least one third top flap. Further, the method can comprise folding the at least one first top flap and the at least third top flap with respect to bottom panel about the first longitudinal fold line and the third longitudinal fold line to close a first end of the carton. Further still, the method can include at least partially closing a second end of the tubular structure. The method can also include loading the tubular structure with a plurality of containers.

According to yet another aspect, a bottom receptacle of the carton can be constructed to have a height that extends above the bottom panel of the carton, below which there are no seams sealed by glue or other adhesives. The bottom receptacle may therefore be liquid-tight.

Other aspects, features, and details of the present disclosure can be more completely understood by reference to the following detailed description, taken in conjunction with the drawings and from the appended claims.

BRIEF DESCRIPTION OF THE DRAWINGS

According to common practice, the various features of the drawings discussed below are not necessarily drawn to scale. Dimensions of various features and elements in the drawings may be expanded or reduced to illustrate more clearly the embodiments of the disclosure.

Corresponding parts are designated by corresponding reference numbers throughout the drawings.

DETAILED DESCRIPTION OF THE EXEMPLARY EMBODIMENTS

A carton suitable for storing and dispensing articles such as, for example, beverage cans, and a method of erecting such a carton from a carton blank are disclosed. The carton provides a bottom receptacle suitable for accommodating, for example, liquids, ice, or other coolants in the carton bottom. In one exemplary embodiment, ice can be added to the opened top of the carton to cool beverage containers held within the carton. As the ice melts, all or a part of the resultant runoff water may be held within the bottom receptacle.

Articles that may be contained in such a carton include, but are not limited to, petaloid bottle containers, beverage cans, glass or plastic bottles, or other containers such as those used in the packaging of juices and other food stuffs. For purposes of illustration and not limitation, the disclosure below describes a carton within the context of a container for beverage cans. However, any other appropriate articles might be substituted for the beverage cans within the scope of the invention exemplified by the present disclosure. Further, references herein to "end," "side," "bottom," and "top" refer to orientations or positions of elements when the carton is erected and disposed in an upright orientation. The terms "upper," "lower," "vertical," "horizontal," and "oblique," generally refer to the location and/or orientation of an element or line with respect to a drawing figure in which it appears.

Figure 1:
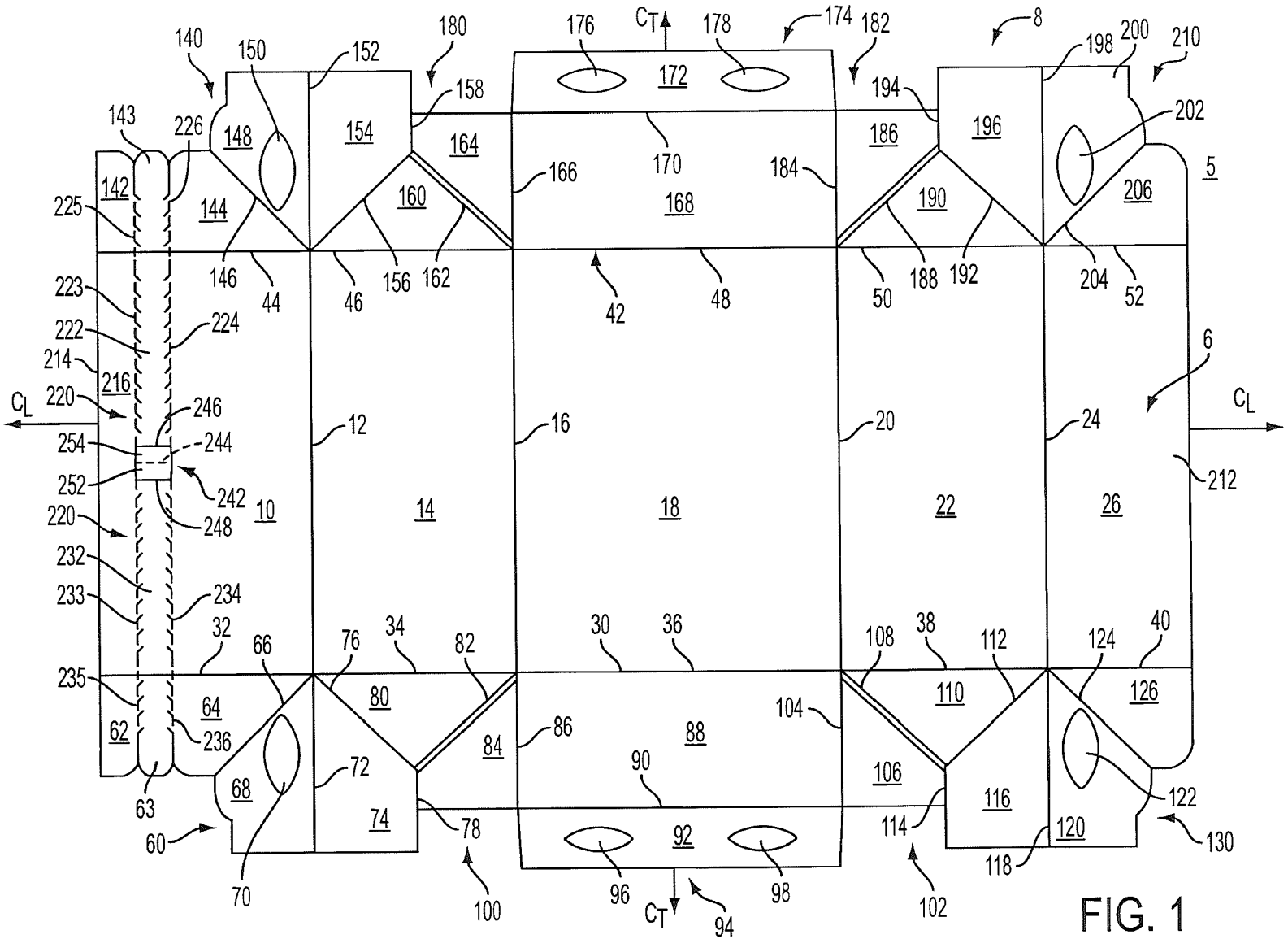
FIG. 1 is a plan view of an exterior side of a blank used to form a carton according to a first embodiment of the disclosure.
Figure 2:
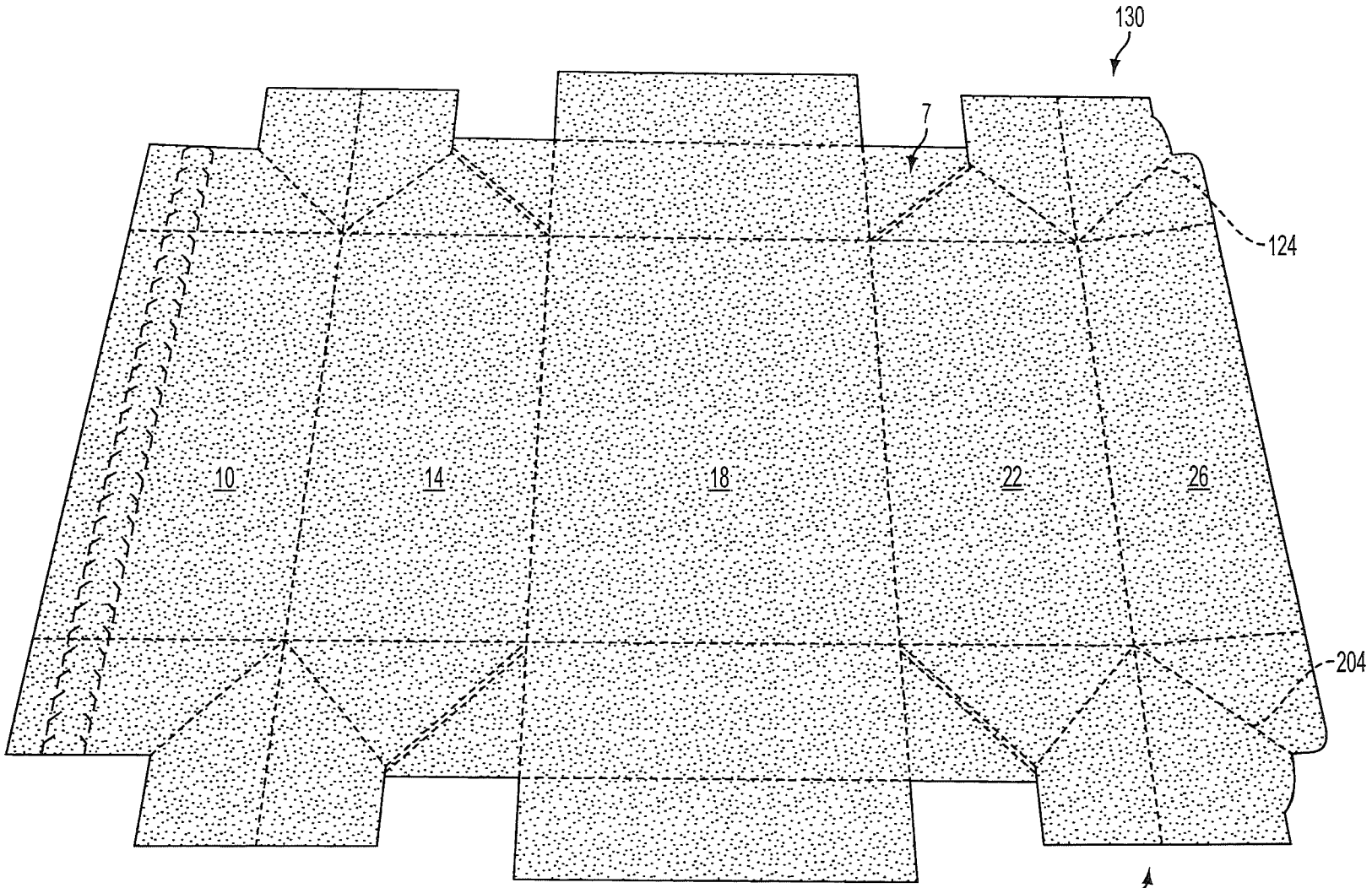
FIG. 2 is a plan view of an interior side of the blank used to form the carton.

Referring now in more detail to the drawing figures, wherein like reference numerals indicate like parts throughout the several views, FIG. 1 illustrates a carton blank 8 from which a carton according to this disclosure may be erected. The exterior or printed side surface 6 of the blank 8 is shown in FIG. 1 and the interior or non-printed side surface 7 is shown in FIG. 2. The blank 8 may be symmetric or nearly symmetric about a transverse centerline $C_T$ and a longitudinal centerline $C_L$. Therefore, certain elements in the drawing figures may be indicated by identical or similar reference numerals in order to reflect the partial or complete symmetries in the blank 8. The blank 8 comprises a bottom panel 18, side panels 14 and 22, a first top panel 10, and a second top panel 26. The bottom panel 18 is foldably connected to side panels 14 and 22 along vertical creases 16 and 20 respectively. Similarly, side panel 14 is foldably connected to first top panel 10 along vertical crease 12 and side panel 22 is foldably connected to second top panel 26 along vertical crease 24. The blank 8 also includes end panels 174 and 94, which are foldably connected to bottom panel 18 along horizontal creases 48 and 36 respectively. End panel 174 has a lower portion 168 and an upper portion 172 separated by a cut crease 170. A pair of partial cutouts 176, 178 are formed in the upper portion 172 of end panel 174. Similarly, end panel 94, which is substantially a mirror image of end panel 174, includes a lower portion 88 and an upper portion 92 separated by a cut crease 90. A pair of partial cutouts 96, 98 are formed in the upper portion 92 as shown.

A gusset flap 180 is foldably connected to side panel 14 along horizontal crease 46. The gusset flap 180 has an oblique double score line 164 for forming a gusset when the carton is erected as detailed below. Similarly, a gusset flap 100 is connected to the other end of side panel 14 along horizontal crease 34 and includes a double score line 82. Likewise, gusset flaps 182 and 102 are connected to opposed ends of side panel 22 along horizontal creases 50 and 38 and have, respectively, double score lines 188 and 108.

Upper end flap 140 is foldably connected to first top panel 10 along crease 44, which is of a higher gauge (i.e. thicker) than horizontal crease 46. The upper end flap 140 includes a tab 154 that is separated from the gusset flap 180 along a through-score 156, 158. The tab 154 is separated from the remainder of upper end flap 140 along cut crease 152. The upper end flap 140 further includes an oblique nicked cut line 146 and is provided with a partial cutout. Upper end flap 60 is a mirror image of upper end flap 140 and includes a tab 74 separated from gusset tab 100 along a through-score and from remainder of tab 60 along cut crease 72. Oblique nicked cut line 66 and partial cutout 70 are provided on upper end flap 60. In a similar manner, upper end flaps 210 and 130 are foldably connected to second top panel 26 along heavy gauge score lines 52 and 40 respectively. Upper end flap 210 is separated from gusset tab 182 along through-score 192, 194 and from the remainder of flap 210 along cut crease 198. Upper end flap 210 has an oblique nicked cut line 204 and partial cutout 202 and tab 130 has oblique nicked cut line 124 and partial cutout 122. A glue tab or strip 212 is defined along the rightmost edge of second top panel 26 in FIG. 1.

Opening strip 220 is defined across the first top panel 10 by a pair of spaced zipper rules 224 and 222. The opening strip 220 also extends across and to the respective ends of upper end flaps 140 and 60 as shown. A punch-through 242 is formed in the center portion of opening strip 220 for purposes detailed below.

Figure 3:
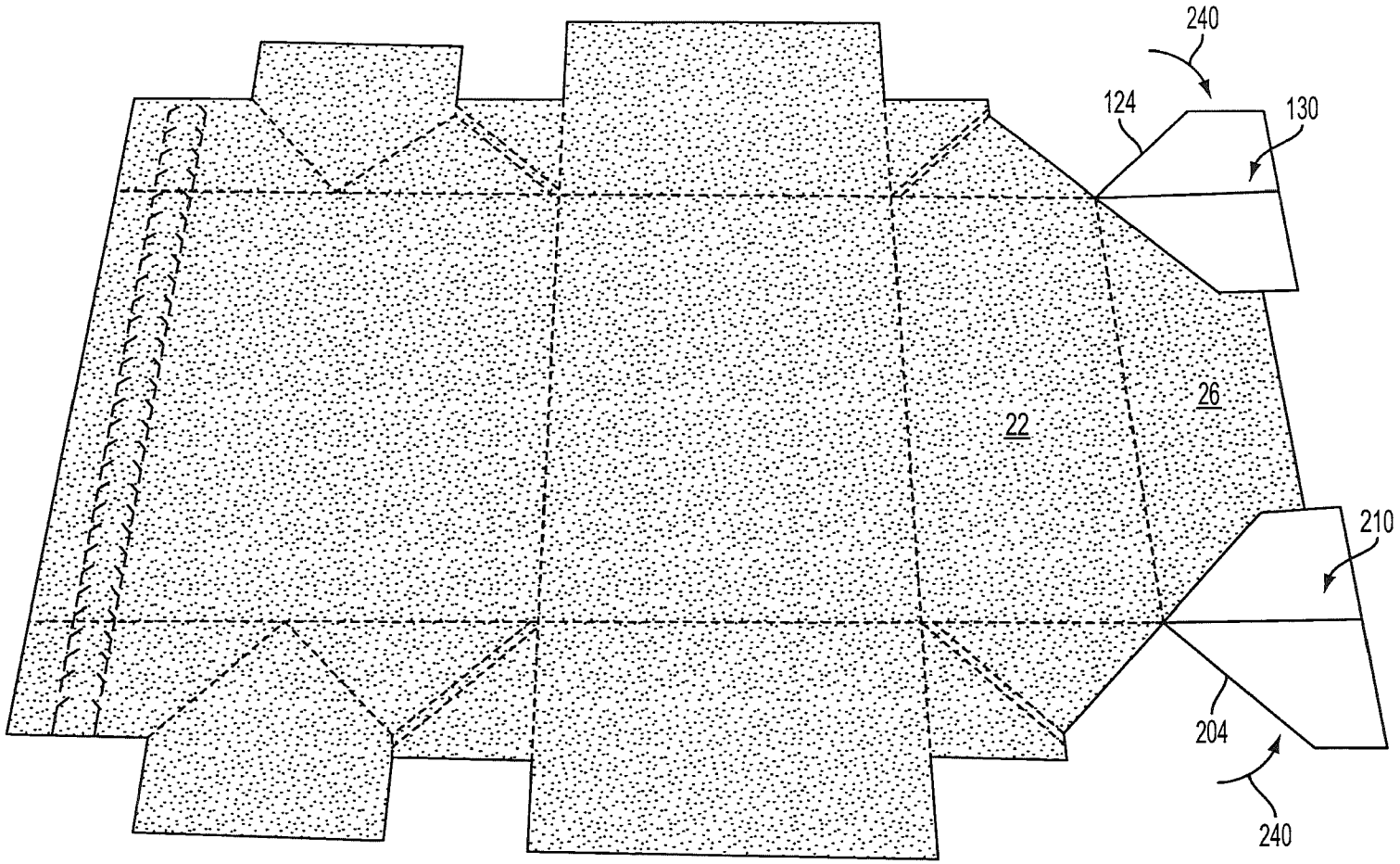
FIGS. 3-11 illustrate a method of erecting the carton.
Figure 4:
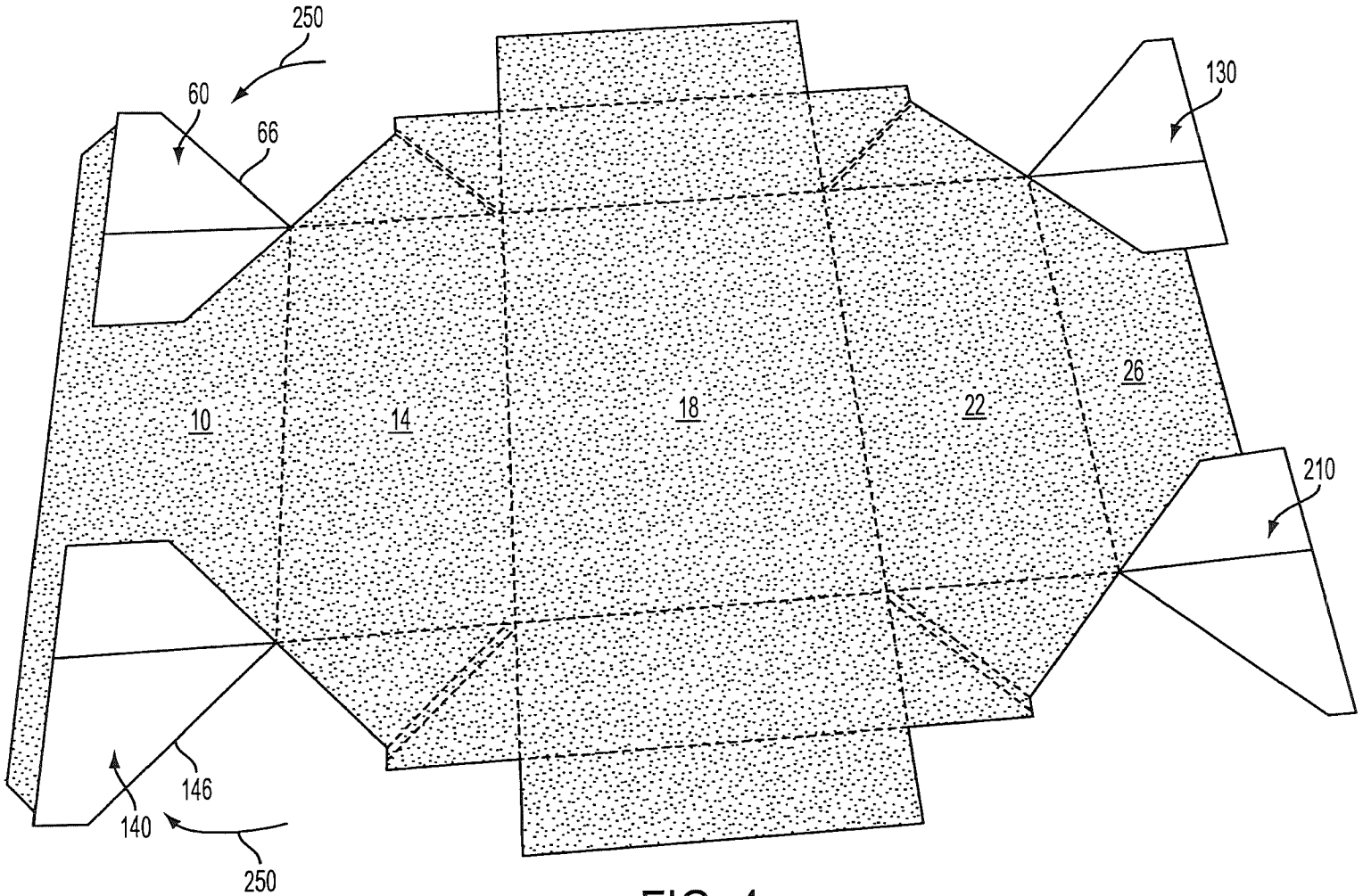
Figure 5:
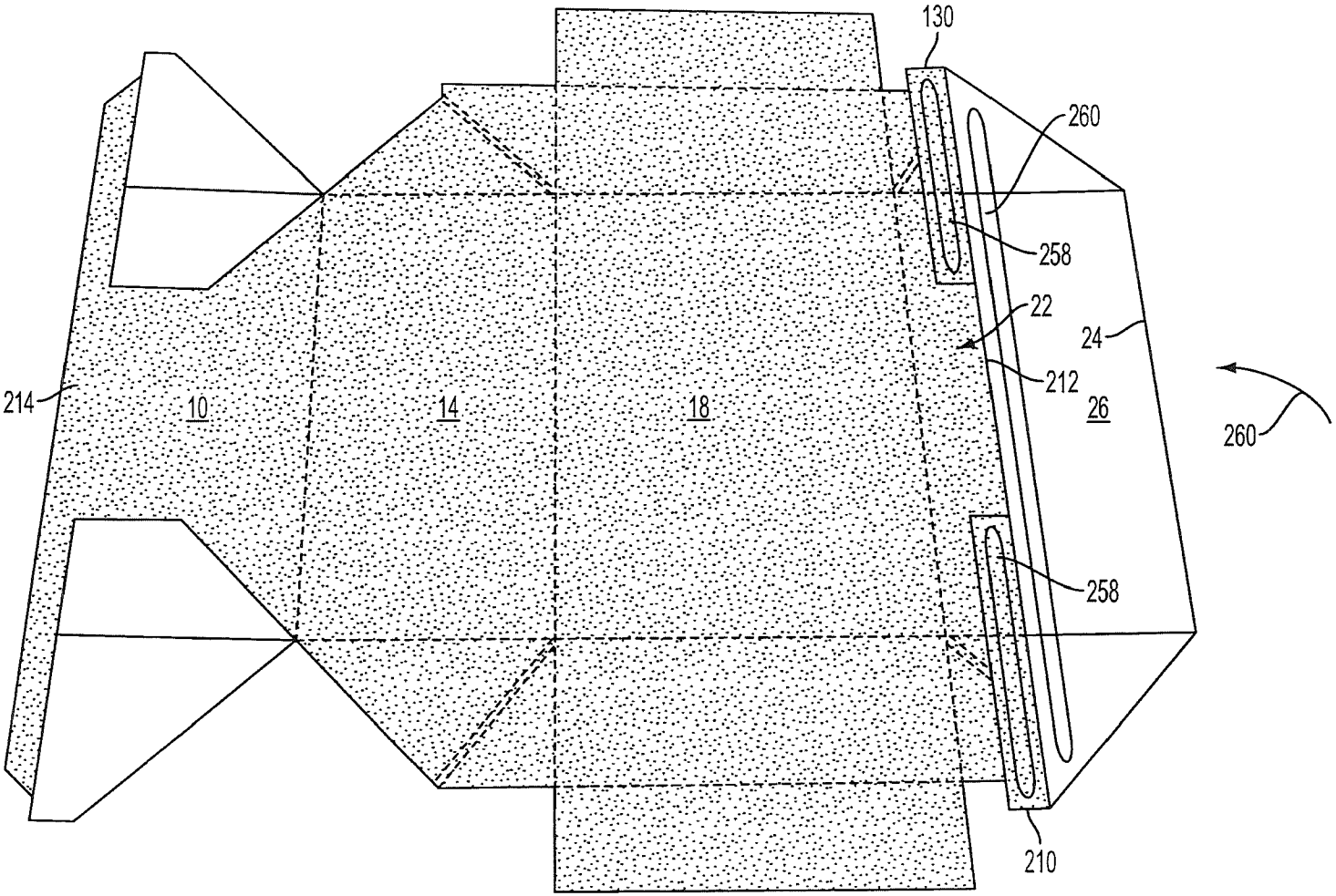

With the blank 8 thus described in detail. FIGS. 2 through 12 illustrate a method of erecting a carton from the blank 8. With the inside surface of the blank 8 facing up in a flat configuration, as that illustrated in FIG. 2, in preparation for erecting the carton, glue is applied along the distal edges of upper end flaps 210 and 130. Upper end flaps 210 and 130 are then folded over along oblique nicked cut lines 204 and 124 in the direction of arrow 240 so that they partially overlie the second top panel 26, as illustrated in FIG. 3. Next, as illustrated in FIG. 4, upper end flaps 140 and 60 are folded along oblique nicked cut lines 146 and 66 in the direction of arrow 250 until they partially overlie the first top panel 10. Optionally, glue can be applied along the leftmost edge of the folded over flaps. This optional glue would adhere to the glue applied to the flaps 210 and 130 when the carton is erected. Referring to FIG. 5, the second top panel 26 is next folded inwardly along crease 24 in the direction of the arrow 260 until it partially overlies side panel 22 exposing the glue 258 applied to flaps 210 and 130. Glue 260 can next be applied along the edge of second top panel 26 as illustrated in FIG. 5. This glue ultimately will adhere to the edge 214 of first top panel 10 in the erected carton.

Figure 6:
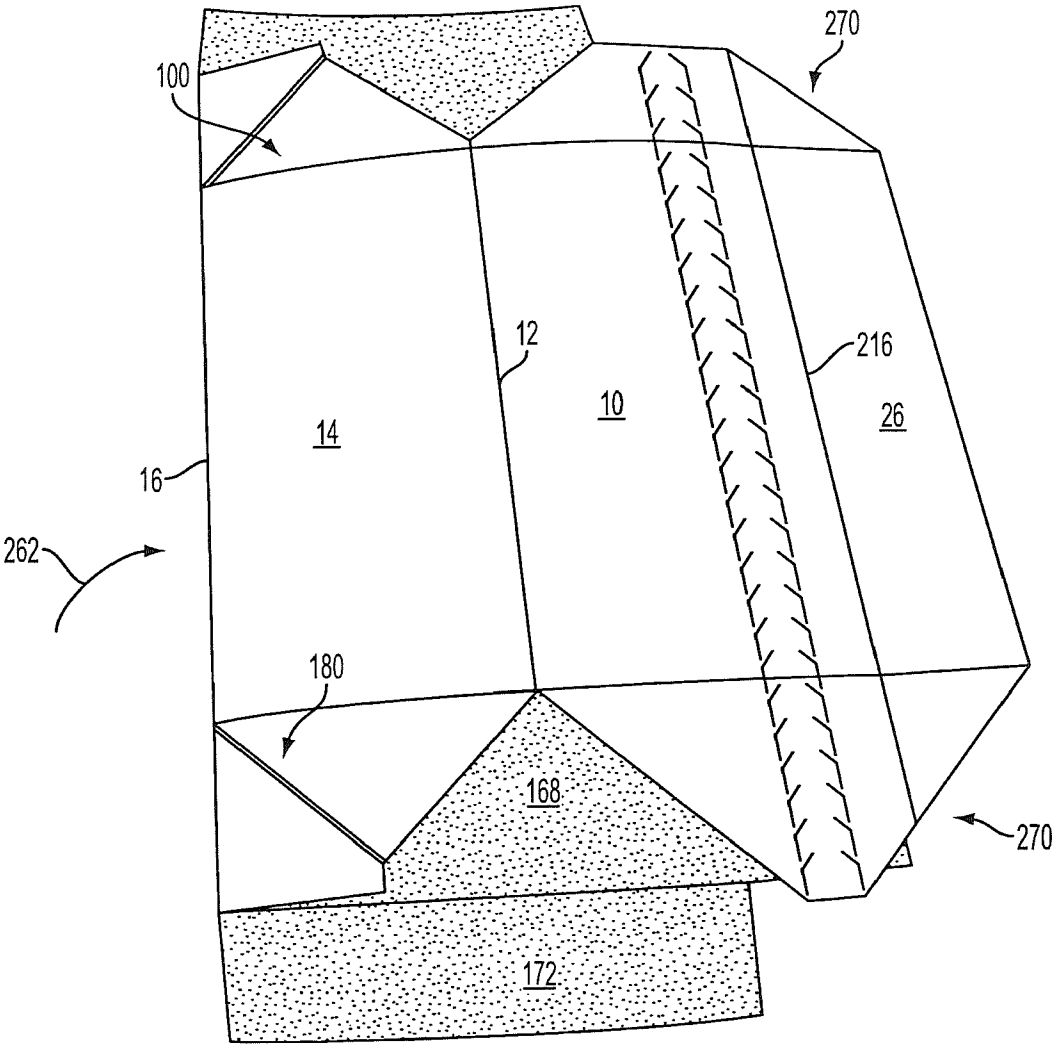

Next, as illustrated in FIG. 6, the blank is folded along crease 16 in the direction of the arrow 262 until edge 214 overlaps edge 212 of the second top panel 26, whereupon the bead of glue 260 previously applied to edge 212 adheres and secures the top panels 10 and 26 together to form a single unitary panel. At the same time, glue 258 secures upper end flap 140 to upper end flap 210 and secures upper end flap 60 to upper end flap 130 to form generally triangular-shaped end flaps 270.

The carton is next folded upwardly in pantograph fashion along creases 12 and 20, which opens up the ends of the carton. The open end of the carton is framed on its sides by gusset flaps 100 and 102, on its bottom by end flap 94, and on its top by triangular outer flap 270. The opposite end of the carton is also open and framed in the same way.

Figure 7A:
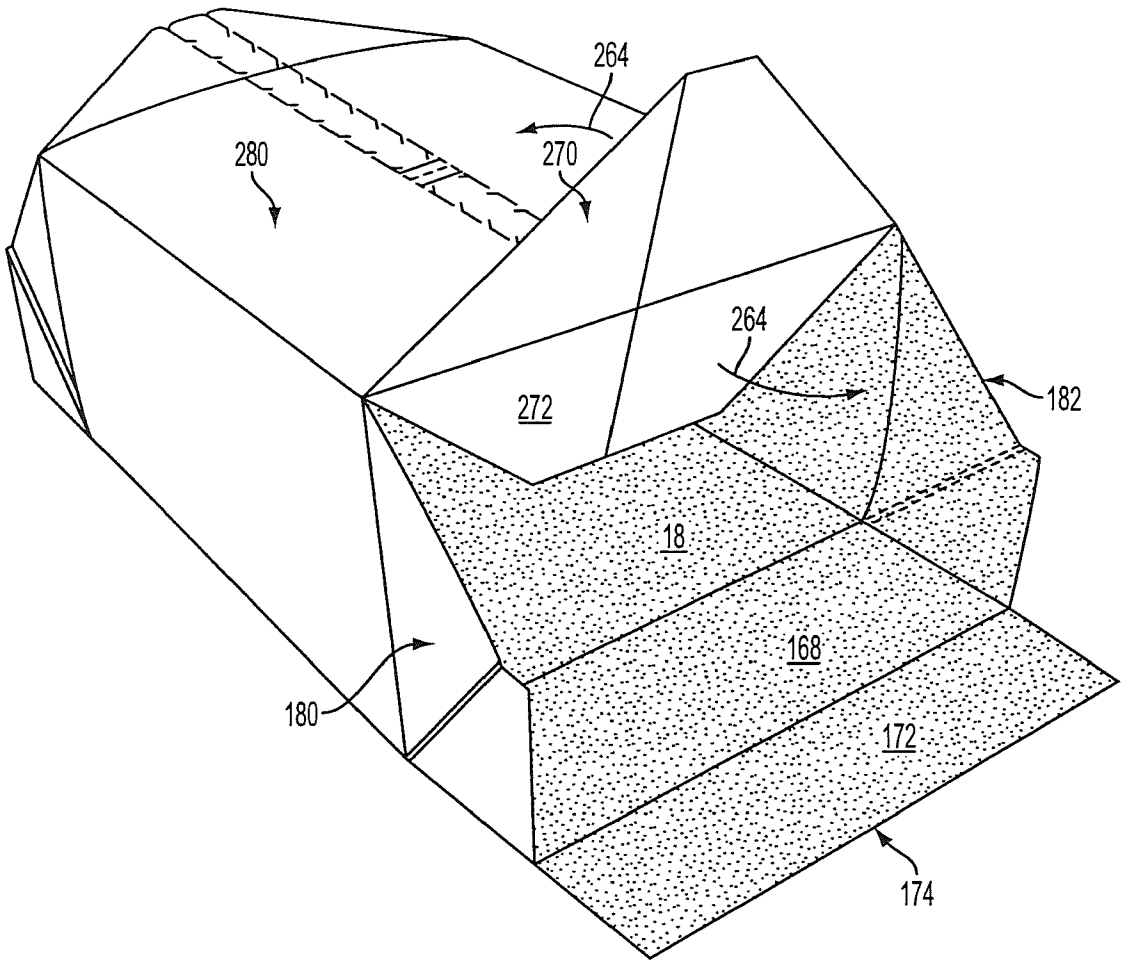
Figure 7B:
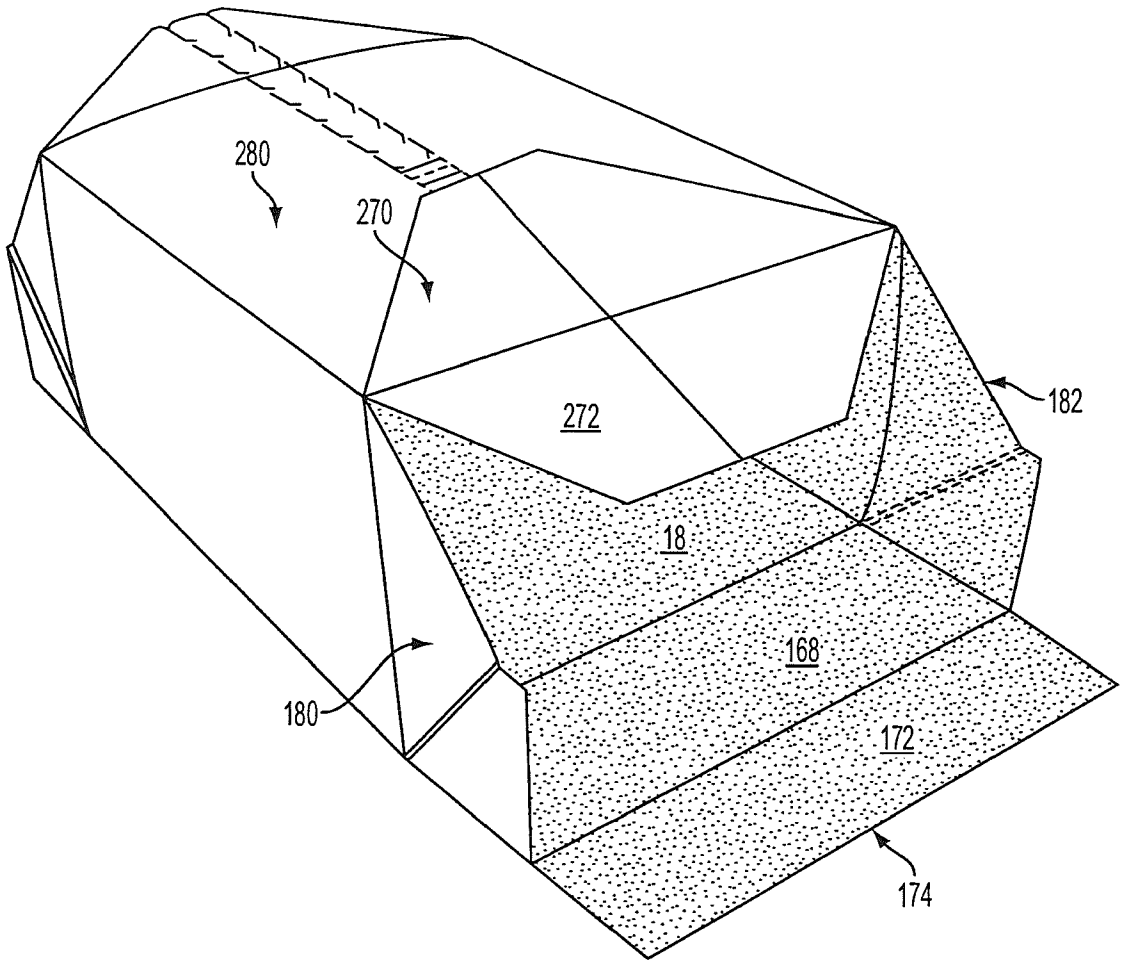
Figure 8:
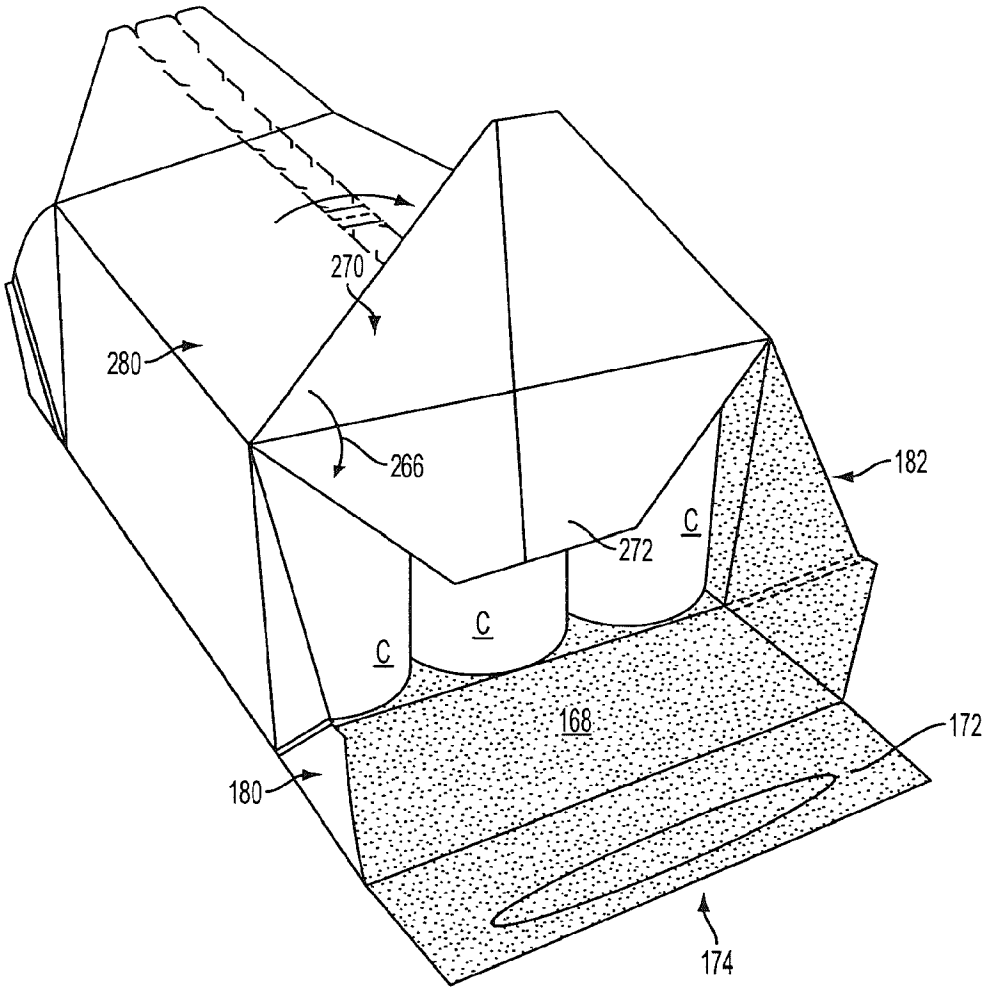

With the carton 280 thus erected, it is configured to be loaded with beverage cans and closed in an automated packaging machine. In the description that follows, it will be understood that the carton can be packed with beverage cans after one end is closed or packed with beverage cans with both ends open, after which each end is closed. The closing of each end proceeds in the following manner. As shown in FIGS. 7A and 7B, the triangular flap 270 is first pivoted up and over in the direction of arrow 264, which pivots the inner triangular flap 272, which also was formed during the erection process, outwardly as indicated by its arrow (FIG. 7A). Further pivoting movement of the triangular flap 270 causes the flap 270 to lie flat against the top of the carton (as shown in FIG. 7B) which, in turn, extends the inner triangular flap 272 outwardly to frame the top of the opened end of the carton. With the carton end thus fully opened up, the carton can be packed with beverage cans, which likely have been pre-grouped by a selector and grouping mechanism of a packaging machine. Typically, the beverage cans C (FIG. 8) are pushed into an open end of the carton as a group by an associated pusher mechanism of the packaging machine, but could be loaded by any method, or individually.

Figure 9:
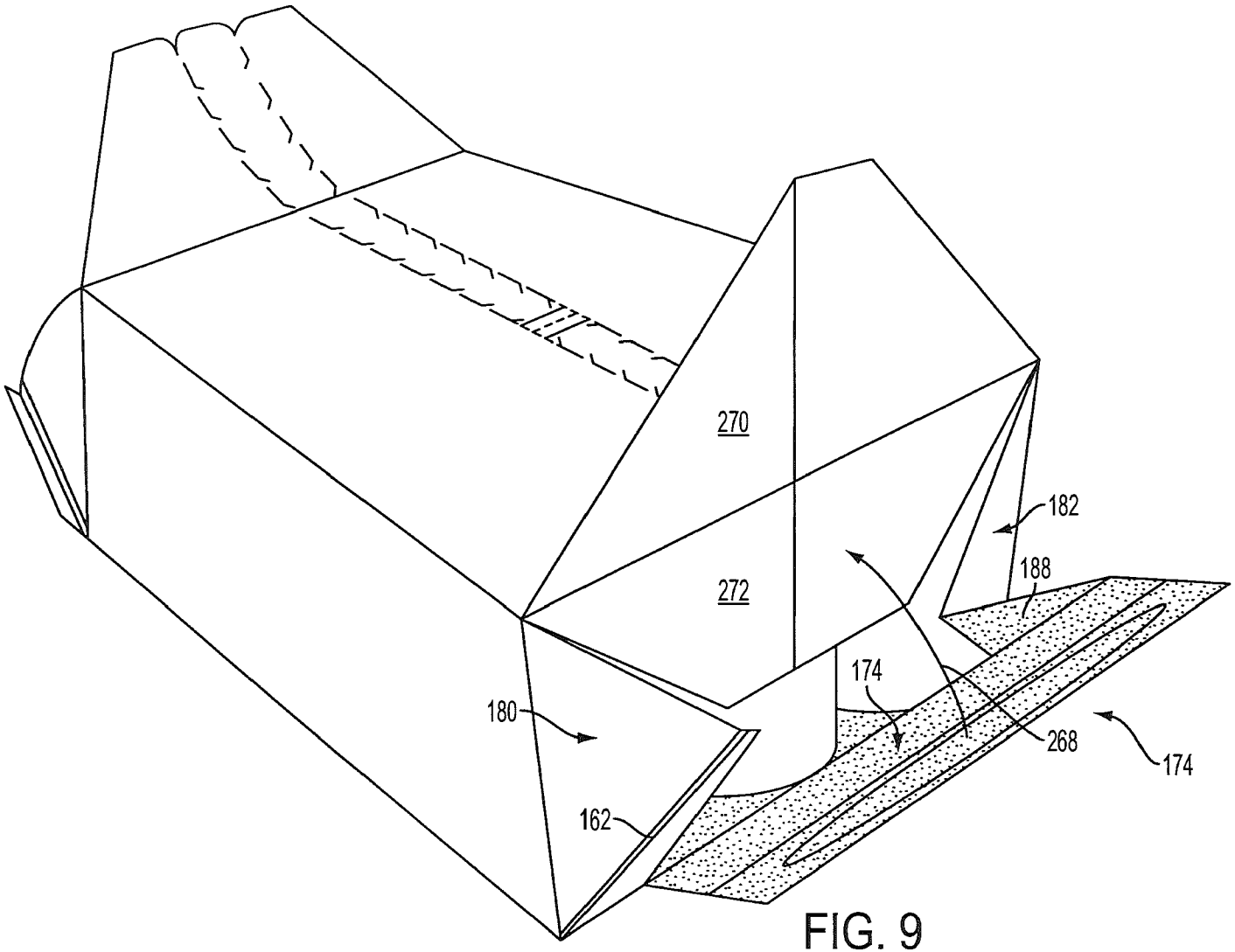

With the carton packed with beverage cans, the open end(s) of the carton can be closed. First, the outer triangular end flap 270 is folded in the direction of arrow 266 in FIG. 8. This movement pivots the inner triangular flap 272 downwardly until it partially covers the open end of the carton 280. With the inner triangular flap 272 thus positioned, the end panel 174 and gusset flaps 180 and 182 can be closed over the end of the carton. More specifically, an adhesive, such as glue, is applied to the upper portion 172 of the end panel 174. Then, as illustrated in FIG. 9, the end panel 174 is folded upwardly in the direction of arrow 268 toward the inner triangular flap 272. This motion also causes the gusset flaps 180 and 182 to begin to fold inwardly on themselves along double score lines 162 and 188 respectively (FIG. 9). It will be appreciated by those skilled in the art that the inwardly folding of the gusset panels 100 and 102 in this manner results in lower corner portions of the carton that are characterized by a continuous unbroken layer or ribbon of paperboard with no breaks or glue seams. This, in turn, forms a carton that, when properly treated, is capable of containing a certain amount of water or other liquid in at least its lower region without leaking.

Figure 10:
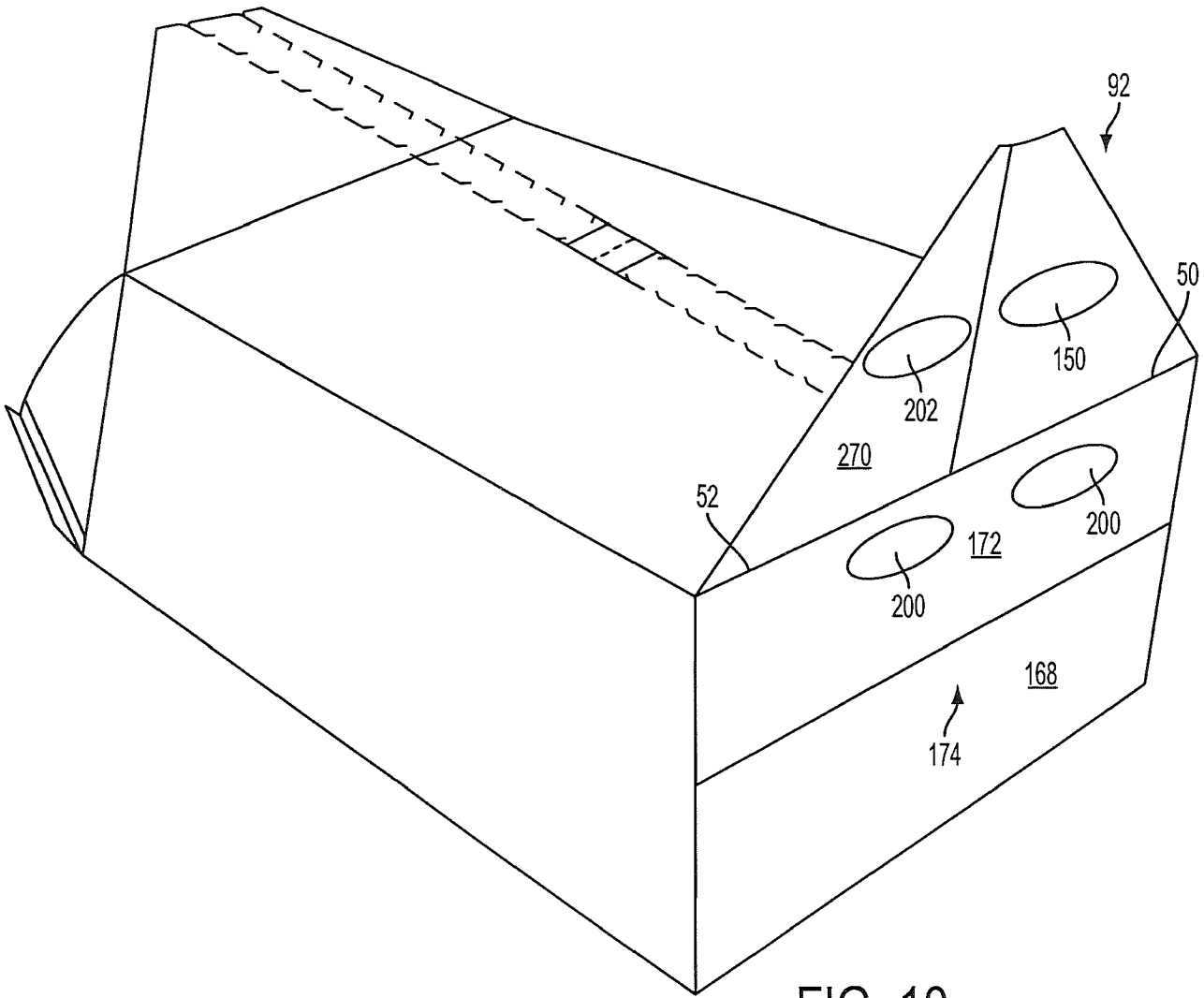
Figure 11:
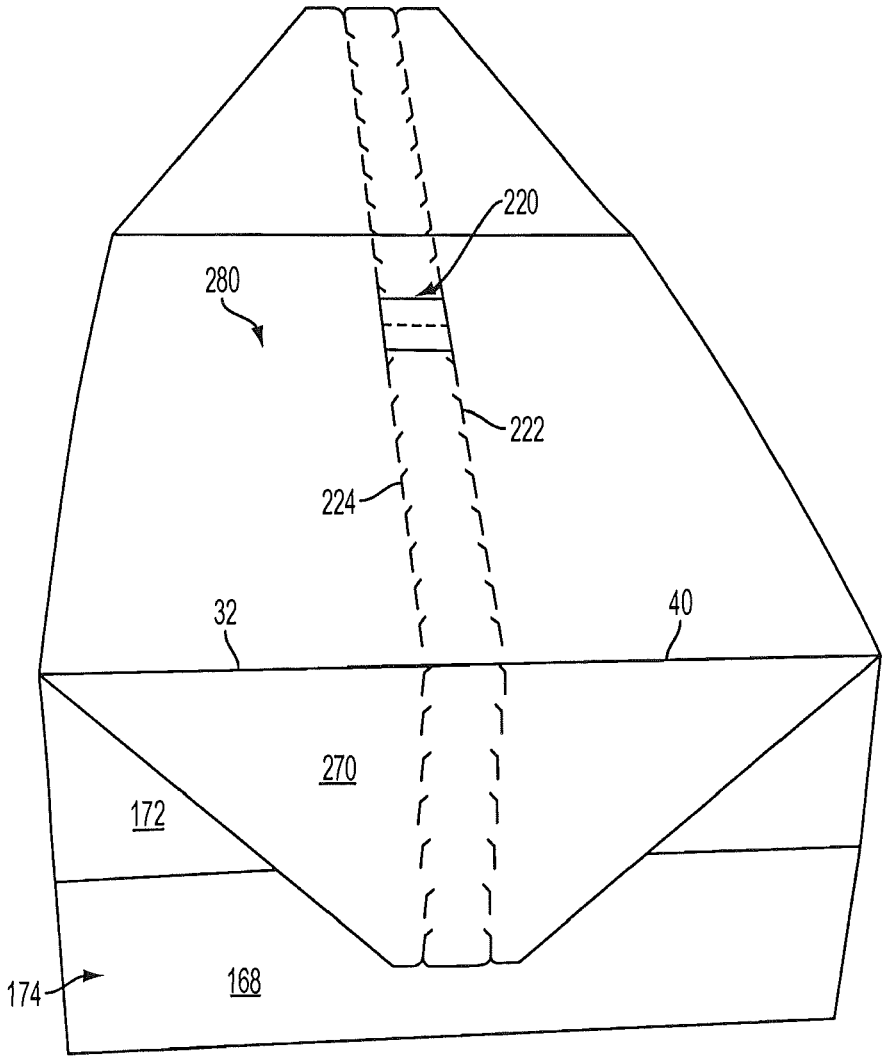

As shown in FIG. 10, the motion of the end flap 174 and consequent inwardly folding of the gusset flaps continues until the end flap overlies the end of the container and the previously applied bead of glue adheres to the inner triangular flap 272. The end of the carton is thus closed behind the beverage cans contained therein with water resistant gussets being formed in the lower corner regions of the carton.

Figure 12:
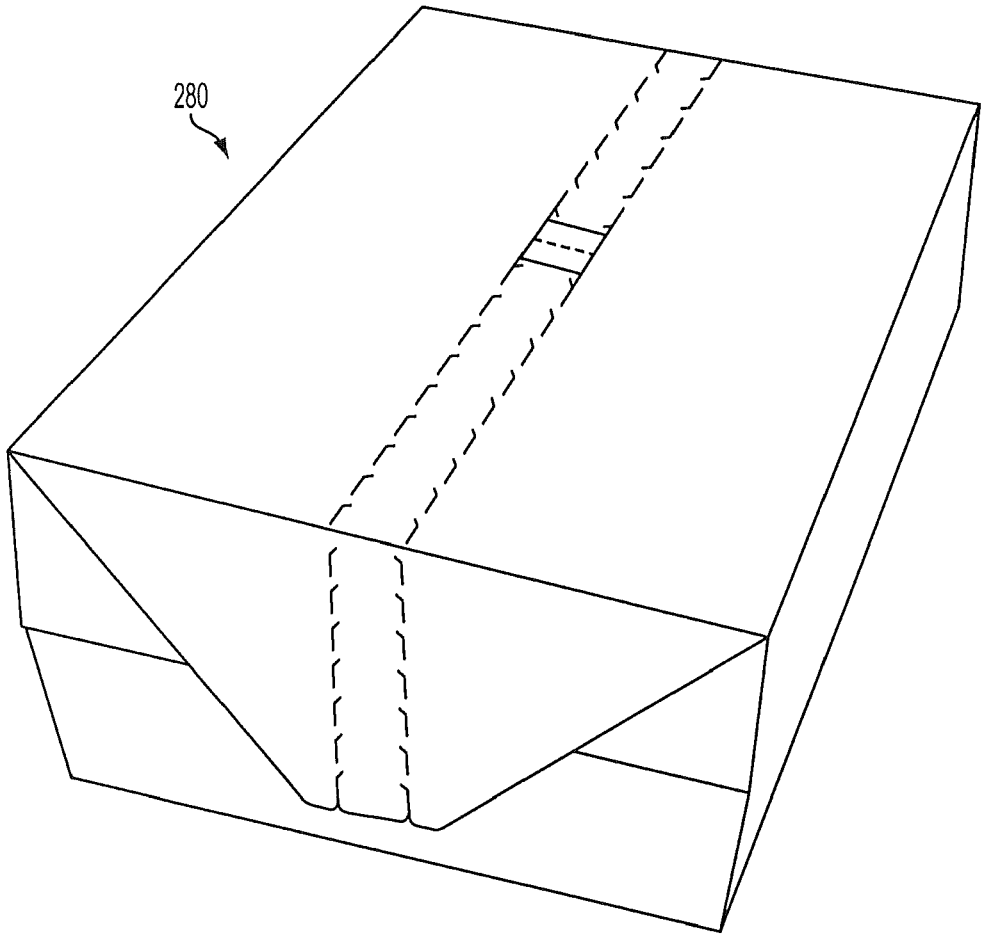
FIG. 12 illustrates the erected carton with containers accommodated therein.

With the end of the carton closed, glue or other adhesive 200 is applied to flap 172 as shown in areas that will underlie the partial cutouts 150 and 202 formed in the outer triangular flap 270 when the flap is folded down. The outer triangular flap 270 is then folded downwardly along now collinear crease lines 50 and 52 until the glue 200 engages and adheres to the partial cutouts 150 and 202 (FIG. 11) formed in the upper portion 172 of the end panel 270. The end of the carton 280 is thereby completely closed. The other end of the carton is closed around the beverage cans therein the same way to result in a package of beverage cans ready for shipment to distributors and/or to retail outlets (FIG. 12).

Figure 13:
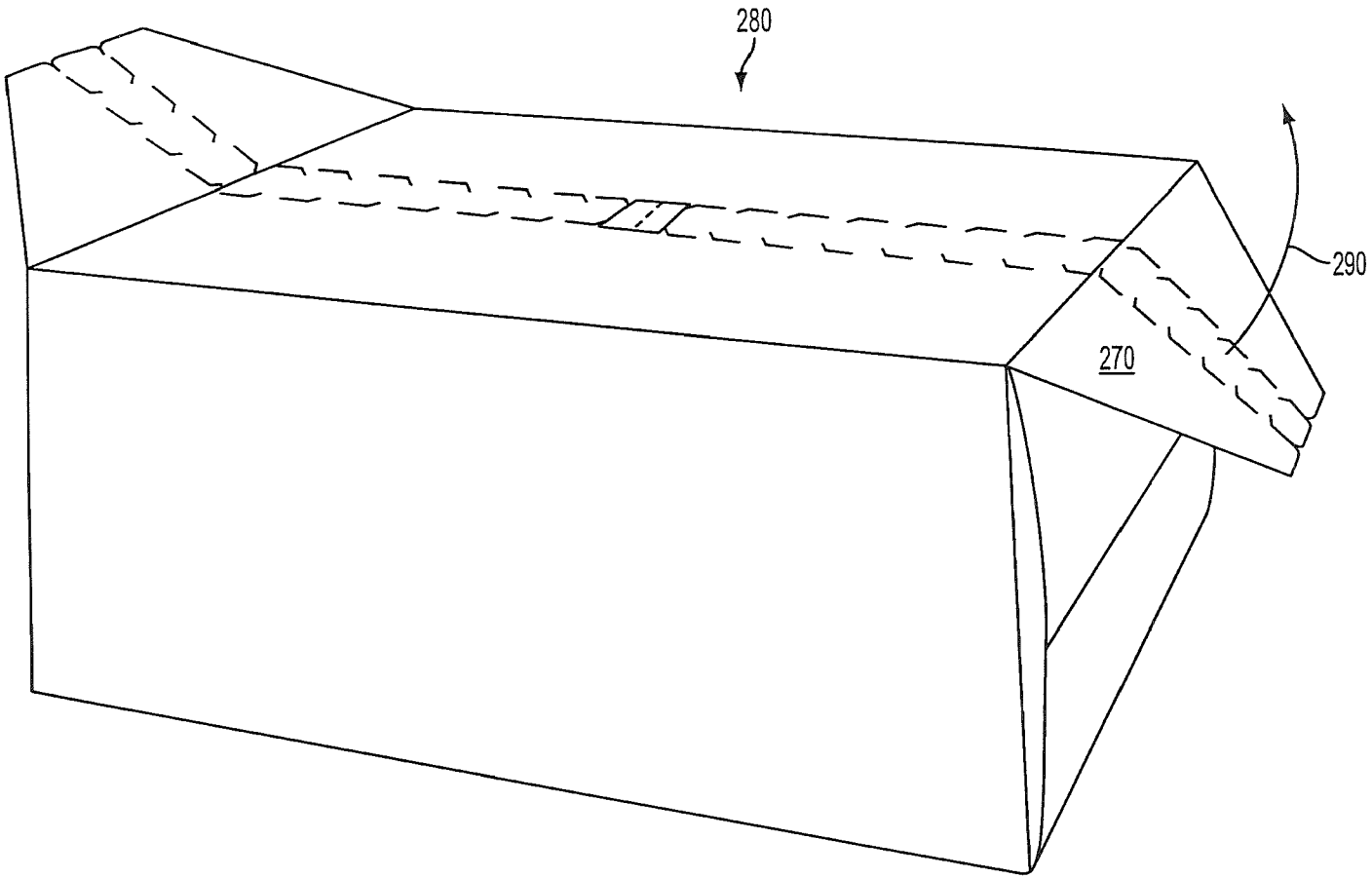
FIGS. 13-17 illustrate steps of opening the carton.
Figure 14:
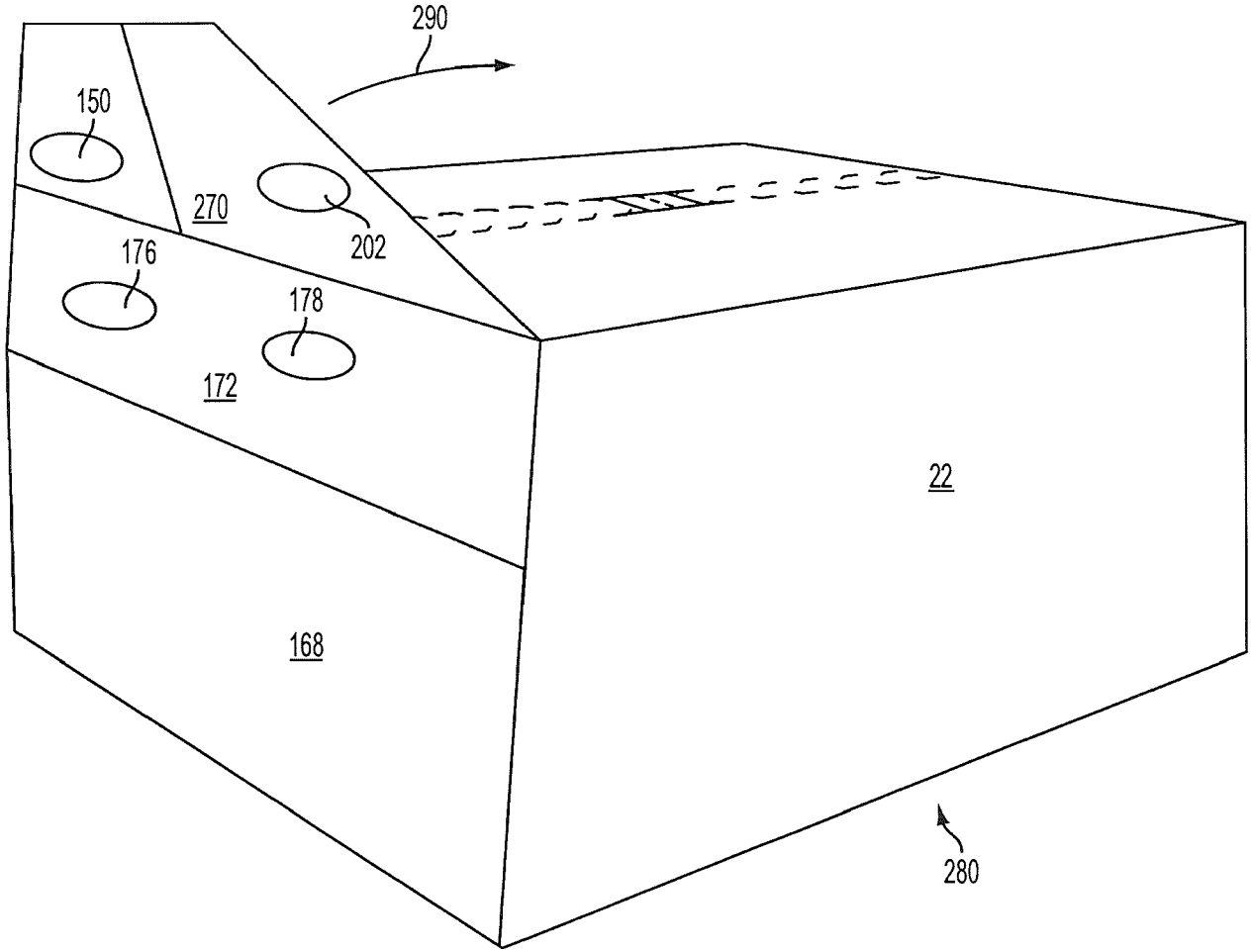
Figure 15:
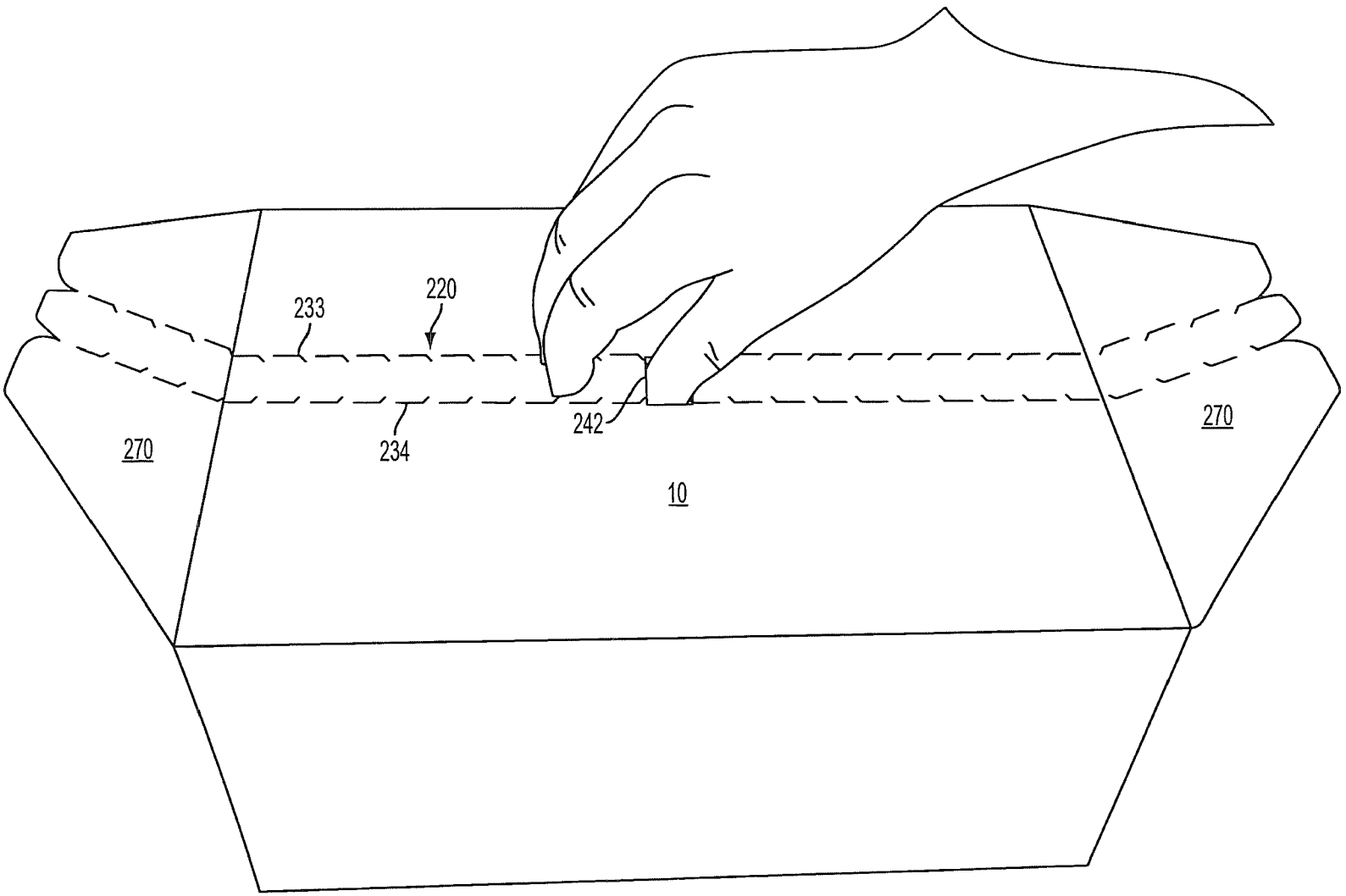

FIGS. 13 through 19 illustrate how the carton of this disclosure is opened by a user to provide access to the beverage cans contained therein and simultaneously to form an ice retaining chimney into which ice can be poured covering the cans to keep them cool. Referring to FIG. 13, a user first inserts his or her fingers beneath the outer triangular flap 270 at the closed ends of the carton and pulls upwardly in the direction of arrow 290. As the user continues to pull, the adhesive that secures the outer triangular flap 270 to the end panel begins to detach. More specifically, as shown in FIG. 14, the partial cutouts 150, 202, 176, and 178 within which the glue is applied tend to rip out rather cleanly from the surface of the paperboard when the flap 270 is moved in direction 290 to prevent unsightly tears and to make it easier to detach the outer triangular flap from the end. The outer triangular flap on the other end of the carton is then detached and folded upwardly in the same way (FIG. 15).

Figure 16:
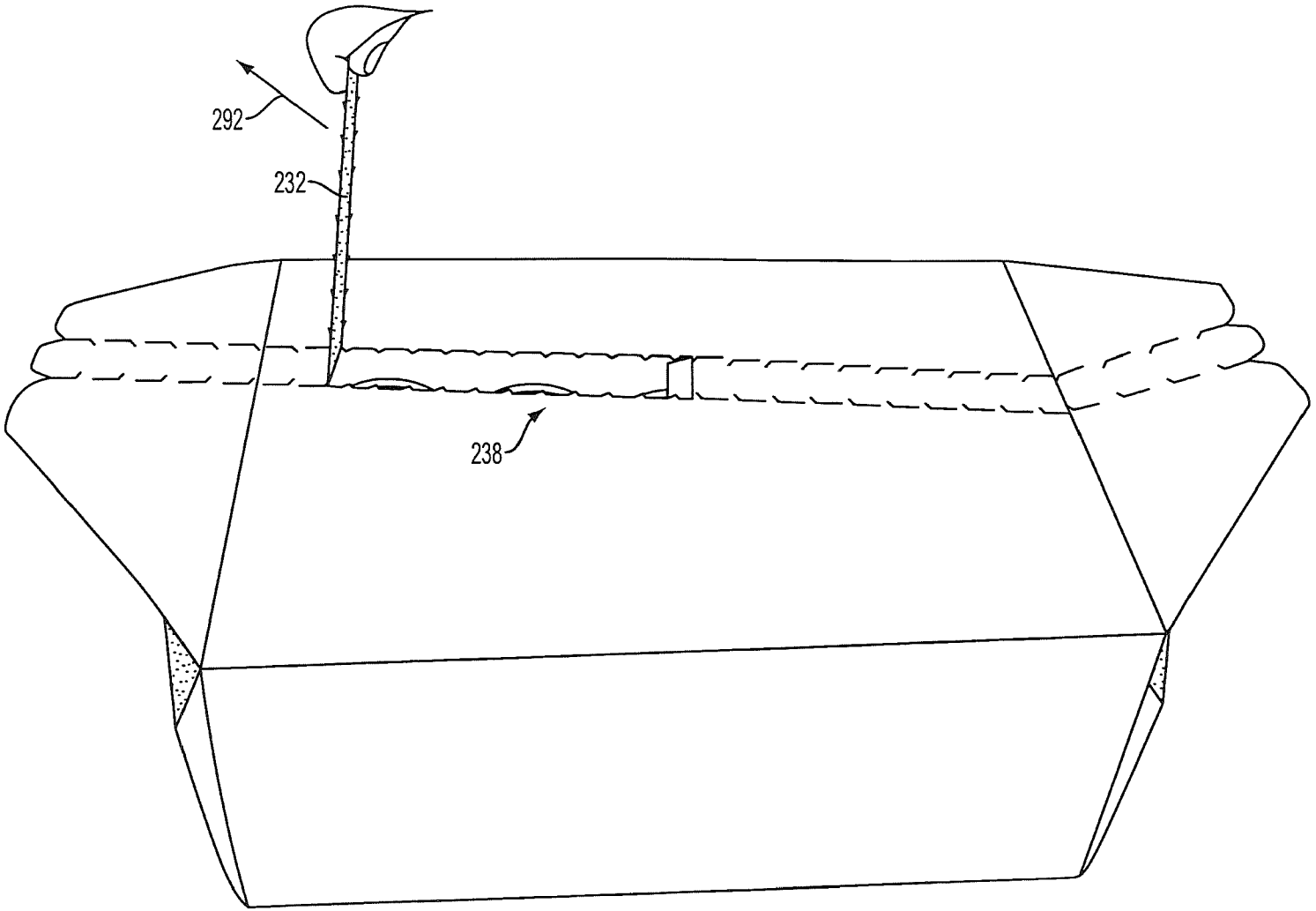
Figure 17:
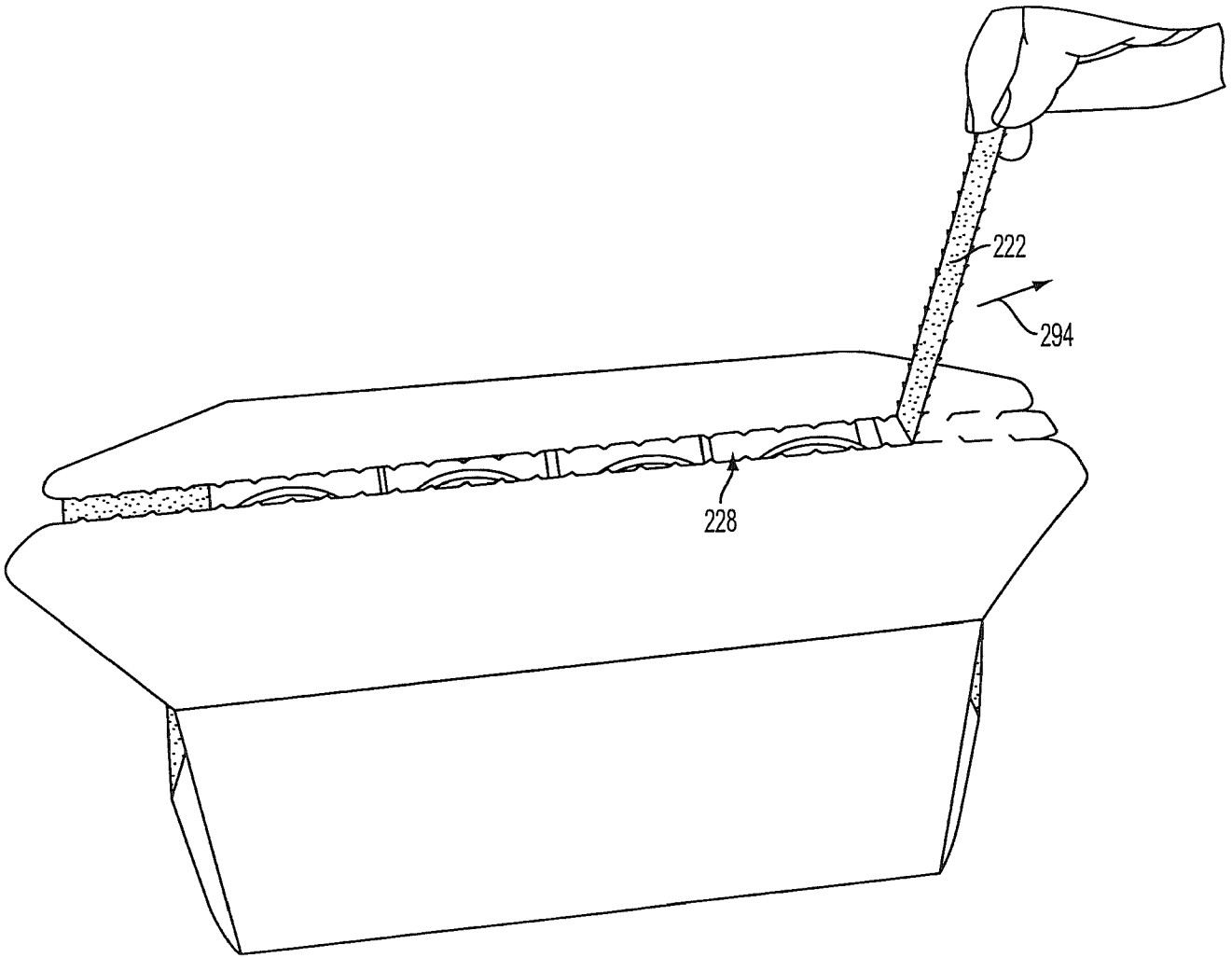
Figure 18:
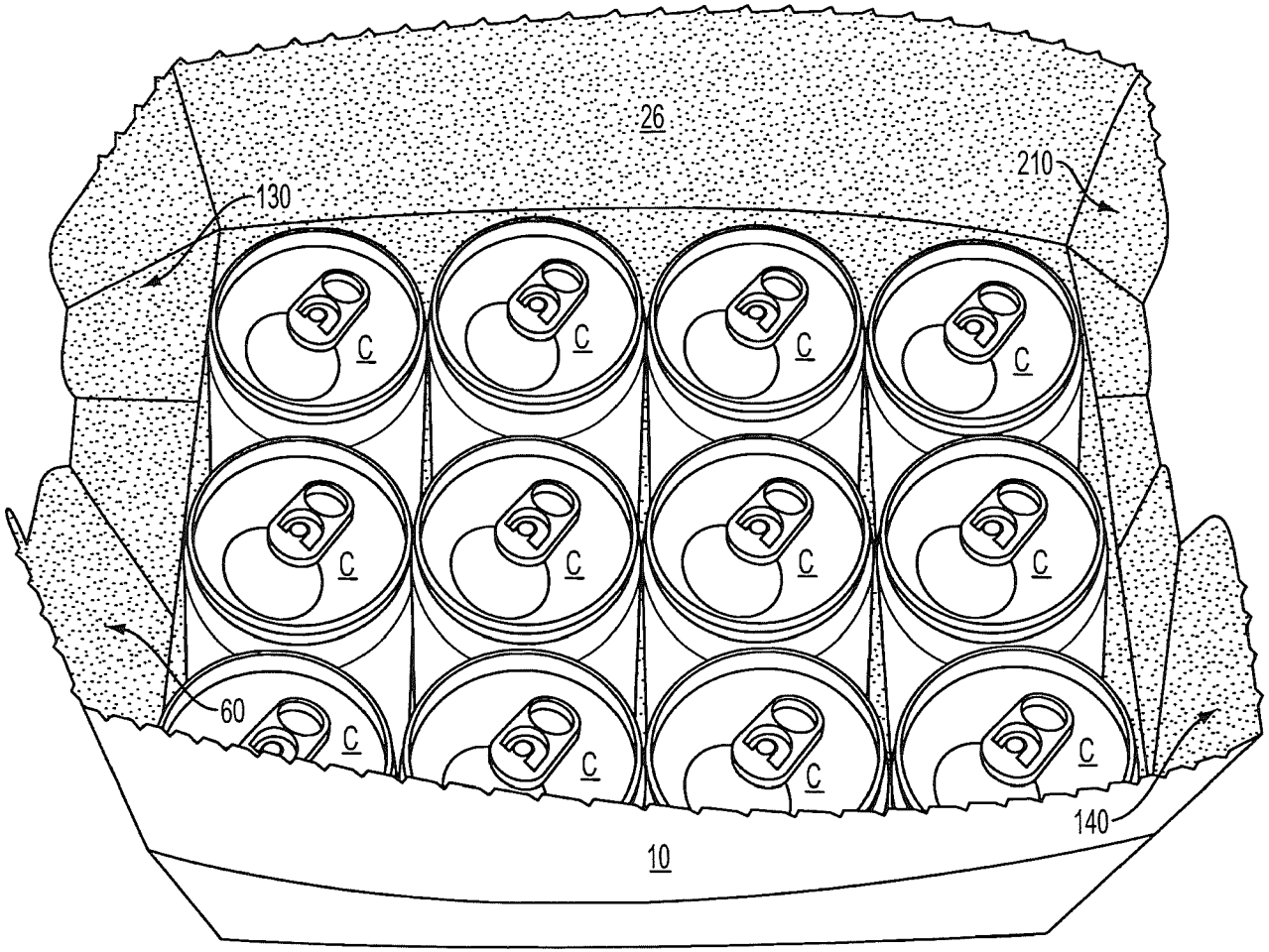
FIG. 18 illustrates the opened carton.
Figure 19:
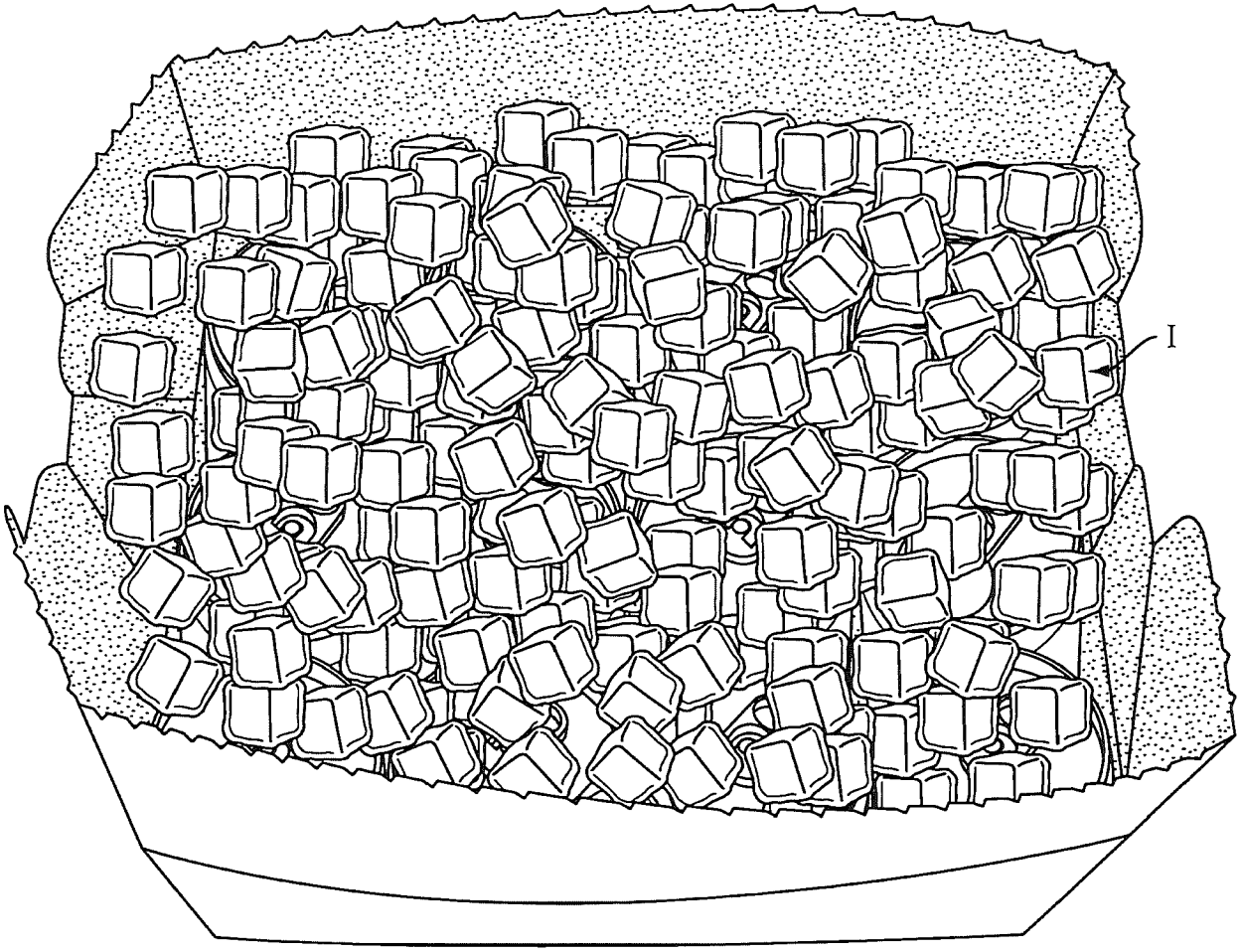
FIG. 19 illustrates the opened carton filled with ice.

As best illustrated in FIG. 15, with the outer triangular flaps 270 detached, the user may insert his or her thumb through the punch-through 242 formed in the central region of the opening strip 220. The user then pulls upwardly in the direction 292, which causes the opening strip 220 to begin to "unzip" or tear away from the top of the carton along zipper rules 224 and 222 (FIG. 16). The carton thus begins to open up to reveal the beverage cans contained therein. Next, the other end of the opening strip 220 is zipped away in the same manner (pulled in the direction 294) to open the top of the carton completely for accessing the beverage cans therein (FIG. 17). With the carton top breached, it can then be opened up as shown in FIG. 18. When so opened, the first top panel 10, second top panel 26 and upper end flaps 60, 130, 140, and 210 together form an upwardly open chimney or skirt that extends upwardly beyond the tops of the beverage cans. This upwardly open chimney or skirt can be filled with ice I, as illustrated in FIG. 19, which cools the beverage within the beverage cans. The cans can be accessed and removed from the carton simply by reaching through the ice, grasping a can, and pulling it from the carton as if the carton were a traditional ice cooler.

As the ice melts, water begins to collect in the lower regions of the carton. However, because of the configuration of the gussets, the lower region of the carton is defined by a continuous ribbon of paperboard that is unbroken and uninterrupted by glue joints or other artifacts that may allow water to leak from the carton. Thus, for at least a limited period of time, the carton retains water from the melting ice and does not leak on a floor or other support surface.

Figure 20:
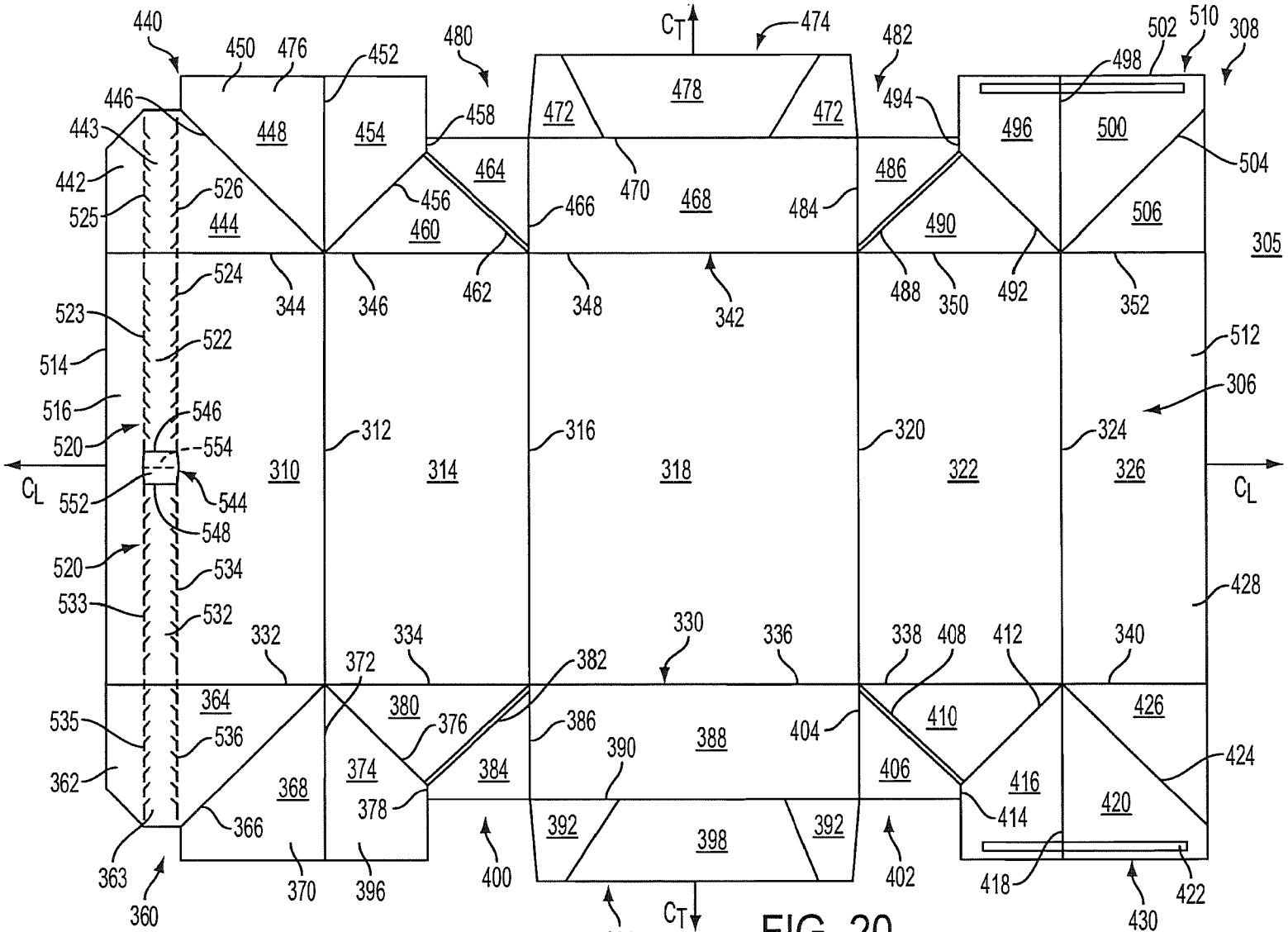
FIG. 20 is a plan view of an exterior side of a blank used to form a carton according to a second embodiment of the disclosure.
Figure 21:
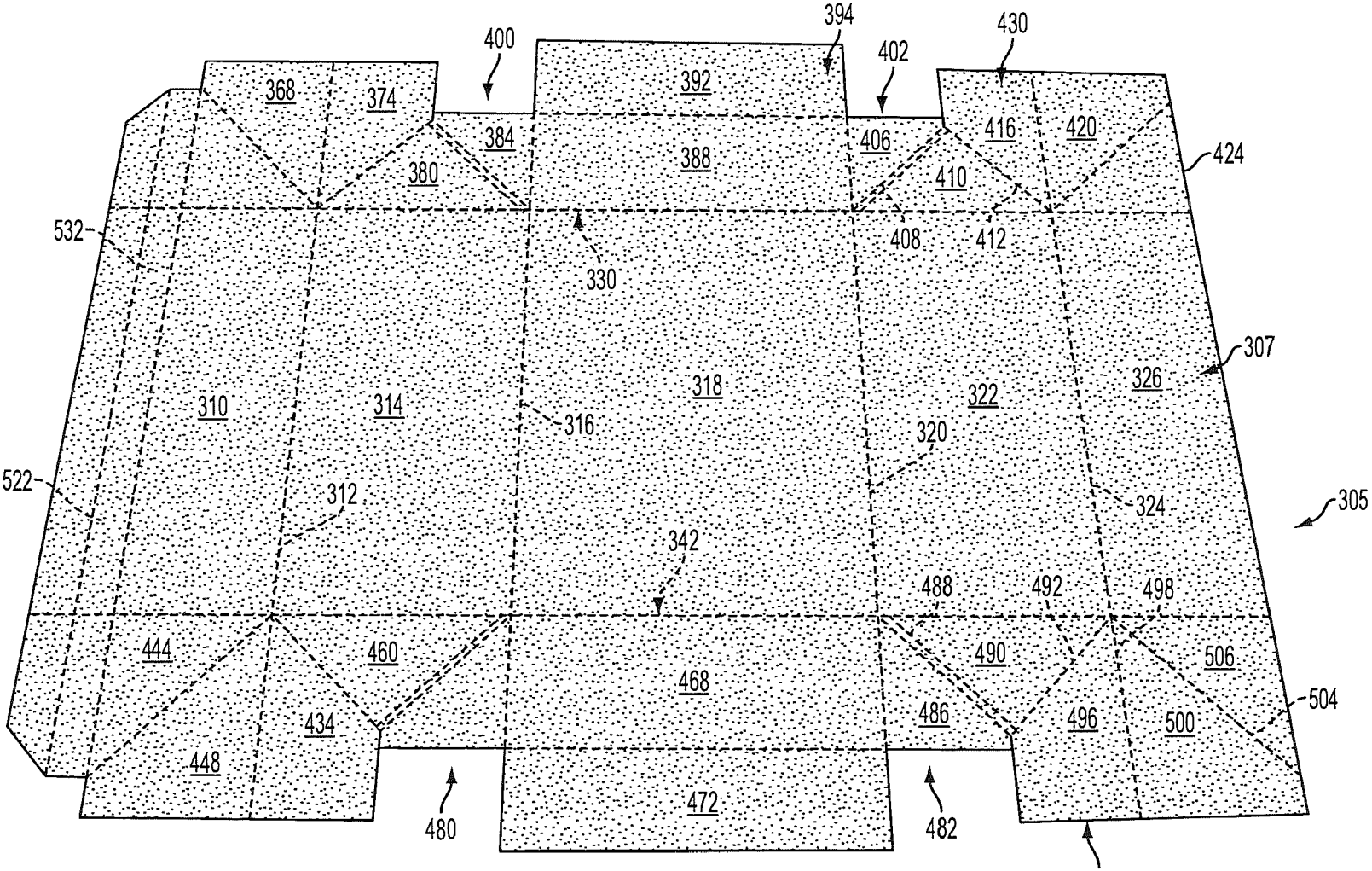
FIG. 21 is a plan view of an interior side of the blank used to form the carton according to the second embodiment of the disclosure.

FIG. 20 is a plan view of a blank 308 used to form a carton 580 (illustrated in FIG. 31) according to a second embodiment of the disclosure. The exterior or printed side surface 306 of the blank 308 is shown in FIG. 20 and the interior or non-printed side surface 307 is shown in FIG. 21. The blank 308 may be symmetric or nearly symmetric about a transverse centerline $C_T$ and a longitudinal centerline $C_L$. Therefore, certain elements in the drawing figures may be indicated by identical or similar reference numerals in order to reflect the partial or complete symmetries in the blank 308.

The blank 308 comprises a bottom panel 318, side panels 314 and 322, a first top panel 310, and a second top panel 326. The bottom panel 318 is foldably connected to side panels 314 and 322 along vertical creases 316 and 320 respectively. Similarly, side panel 314 is foldably connected to first top panel 310 along vertical crease 312 and side panel 322 is foldably connected to second top panel 326 along vertical crease 324. The blank 308 also includes end panels 474 and 394, which are foldably connected to bottom panel 318 along horizontal creases 348 and 336 respectively. End panel 474 has a lower portion 468 and an upper portion 472 separated by a cut crease 470. A glue receiving section 478 is formed in the upper portion 472 of end panel 474. Similarly, end panel 394, which is substantially a mirror image of end panel 474, includes a portion 388 and a portion 392 separated by a cut crease 390. A glue receiving section 398 is formed in 392 as shown.

A gusset flap 480 is foldably connected to side panel 314 along horizontal crease 346. The gusset flap 480 has an oblique double score line 464 for forming a gusset when the carton is erected as detailed below. Similarly, a gusset flap 400 is connected to the other end of side panel 314 along horizontal crease 334 and includes a double score line 382. Likewise, gusset flaps 482 and 402 are connected to opposed ends of side panel 322 along horizontal creases 350 and 338 and have, respectively, double score lines 488 and 408.

Upper end flap 440 is foldably connected to first top panel 310 along crease 344, which is of a higher gauge (i.e. thicker) than horizontal crease 346. The upper end flap 440 includes a tab 454 that is separated from the gusset flap 480 along a through-score 456, 458. The tab 454 is separated from the remainder of upper end flap 440 along cut crease 452. The upper end flap 440 further includes an oblique nicked cut line 446 and is provided with a partial cutout. Upper end flap 360 is a mirror image of upper end flap 440 and includes a tab 374 separated from gusset tab 400 along a through-score and from remainder of tab 360 along cut crease 372. Oblique nicked cut line 366 and partial cutout 370 are provided on upper end flap 360. In a similar manner, upper end flaps 510 and 430 are foldably connected to second top panel 326 along heavy gauge score lines 352 and 340 respectively. Upper end flap 510 is separated from gusset tab 482 along through-score 192, 194 and from the remainder of flap 510 along cut crease 498. Upper end flap 510 has an oblique nicked cut line 504 and partial cutout 502 and tab 430 has oblique nicked cut line 424 and partial cutout 422. A glue tab or strip 512 is defined along the rightmost edge of second top panel 326 in FIG. 20.

Opening strip 520 is defined across the first top panel 310 by a pair of spaced zipper rules 524 and 522. The opening strip 520 also extends across and to the respective ends of upper end flaps 440 and 360 as shown. A punch-through 542 is formed in the center portion of opening strip 520 for purposes detailed below.

The blank 308 includes a breachable or frangible line 544 in the first top panel 310 approximately on the longitudinal centerline $C_L$ of the blank. The frangible line 544 separates respective opening flaps 552 or finger access features that are foldably connected to the first top panel 310 by longitudinal fold lines 546, 548. Transverse tear strips 522, 532 extend from respective opening flaps 552 across the first top panel 310 and across each first top flap 426, 444 connected to the first top panel. In the illustrated embodiment, each of the tear strips 522, 532 are at least partially defined by spaced apart tear lines 523, 524, 533, 534. The blank 308 and carton 580 may have other opening features without departing from the disclosure.

Figure 22:
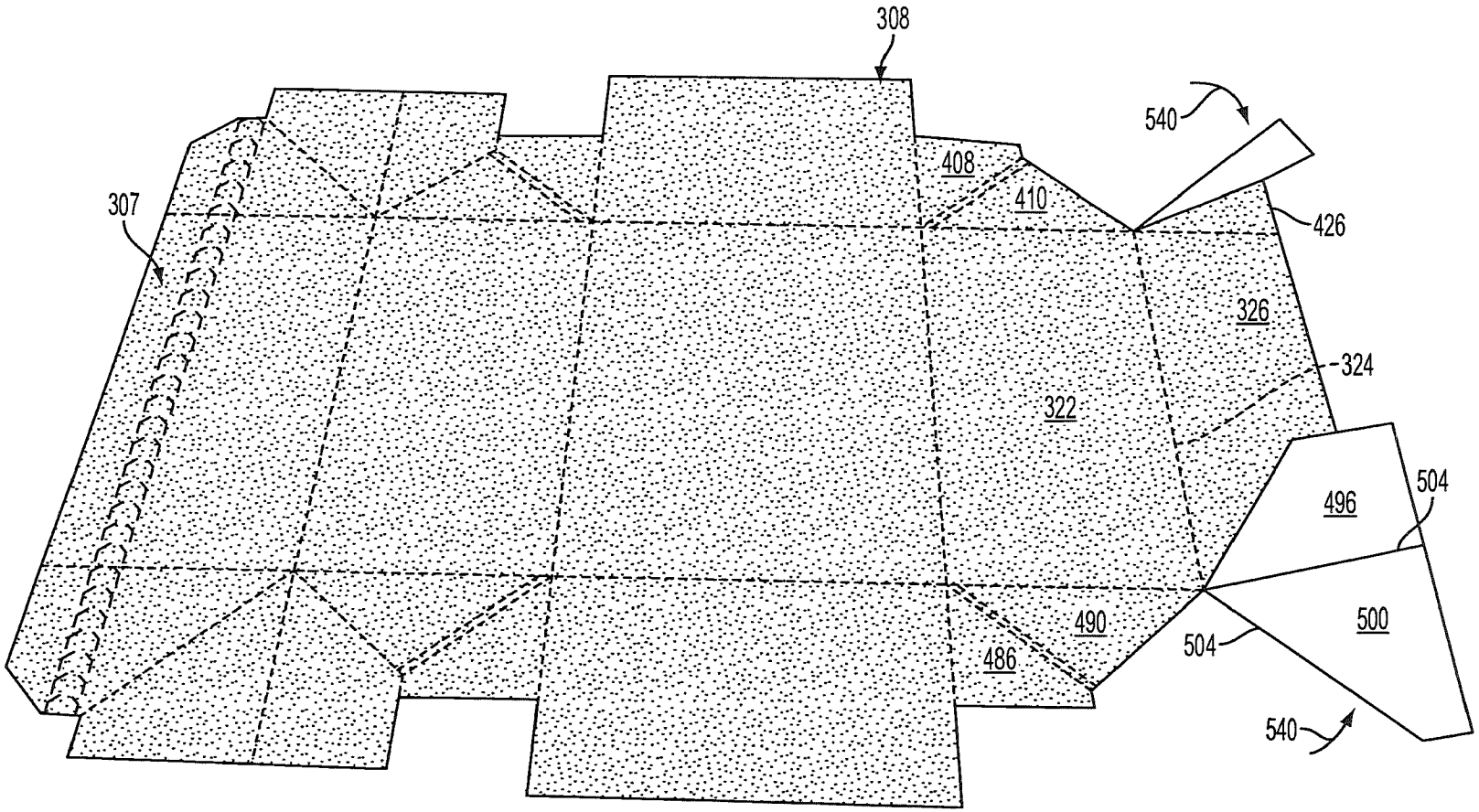
FIGS. 22-31 illustrate a method of erecting the carton according to the second embodiment.

An exemplary method of erection of the blank 308 into the carton 580 and loading of the carton will be discussed with reference to FIGS. 21-31. FIG. 21 illustrates the interior side 307 of the blank 308. FIG. 22 illustrates an initial erection step in which the second top flap 420 and third top flap 416 connected to the second top panel 326 are folded about oblique fold line 426 in the direction of the arrow 540 so that the third top flap 416 and second top flap 420 are positioned with the print/exterior side 306 up.

Figure 23:
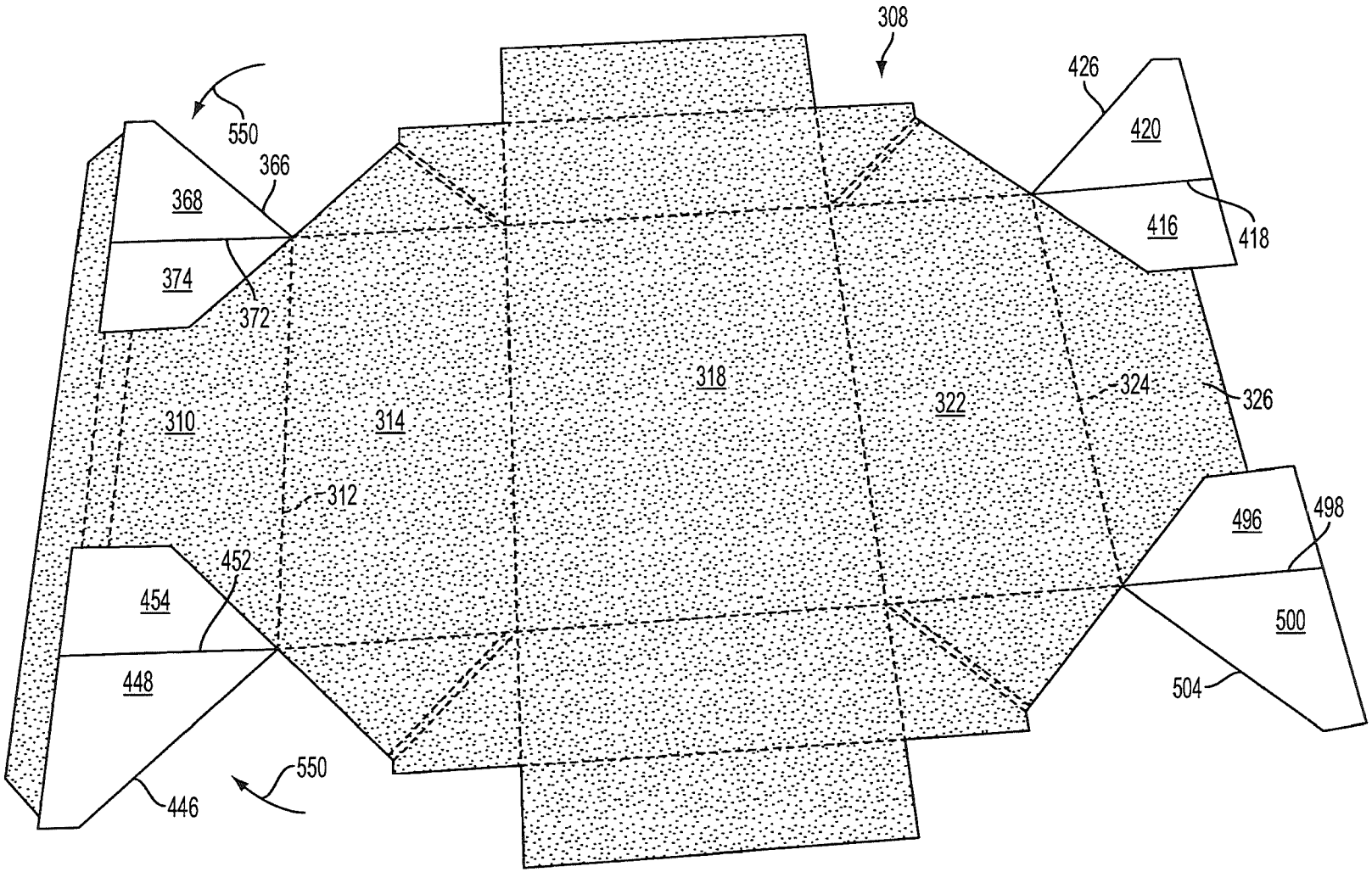

Referring to FIG. 23, the second top flap 368, 374 and third top flap 448, 454 connected to the first top panel 310 are folded about oblique fold line 366, 446 in the direction of arrow 550 so that the third top flap 368, 374 and second top flap 448, 454 are positioned with the print/exterior side 306 up.

Figure 24:
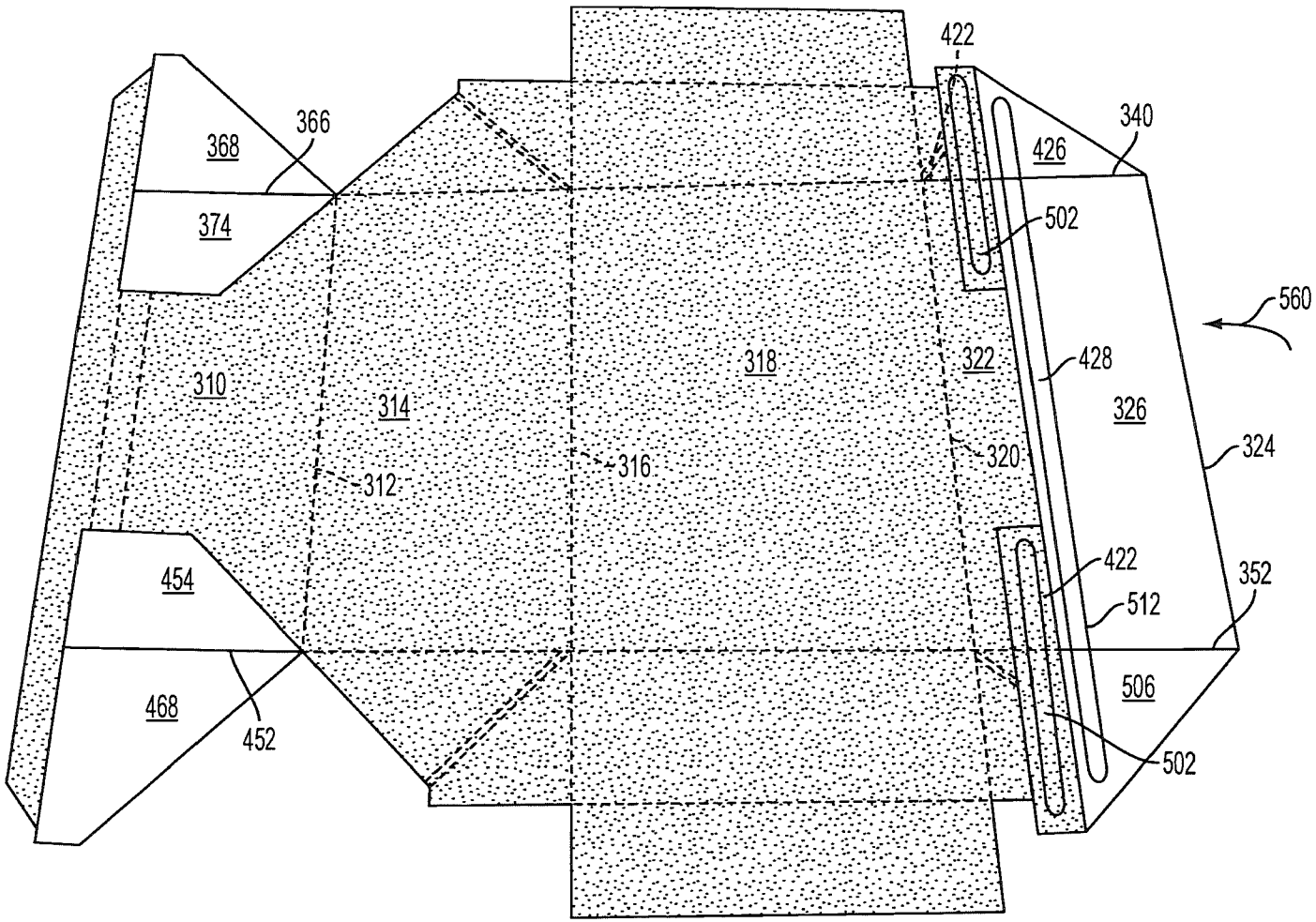

Referring to FIG. 24, the second top panel 326 is folded about lateral fold line 324 in the direction of the arrows 560 so that the first top flaps 426, 506 connected to the second top panel 326 and the second top panel 326 are print side 306 up, and the second top flaps 416, 420 and the third top flaps 496, 500 connected to the second top panel 326 are print side down. As shown in FIG. 24, the adhesive sections 512, 502, 428 are both facing upward and extend outward from the edge of the top panel 326.

Figure 25:
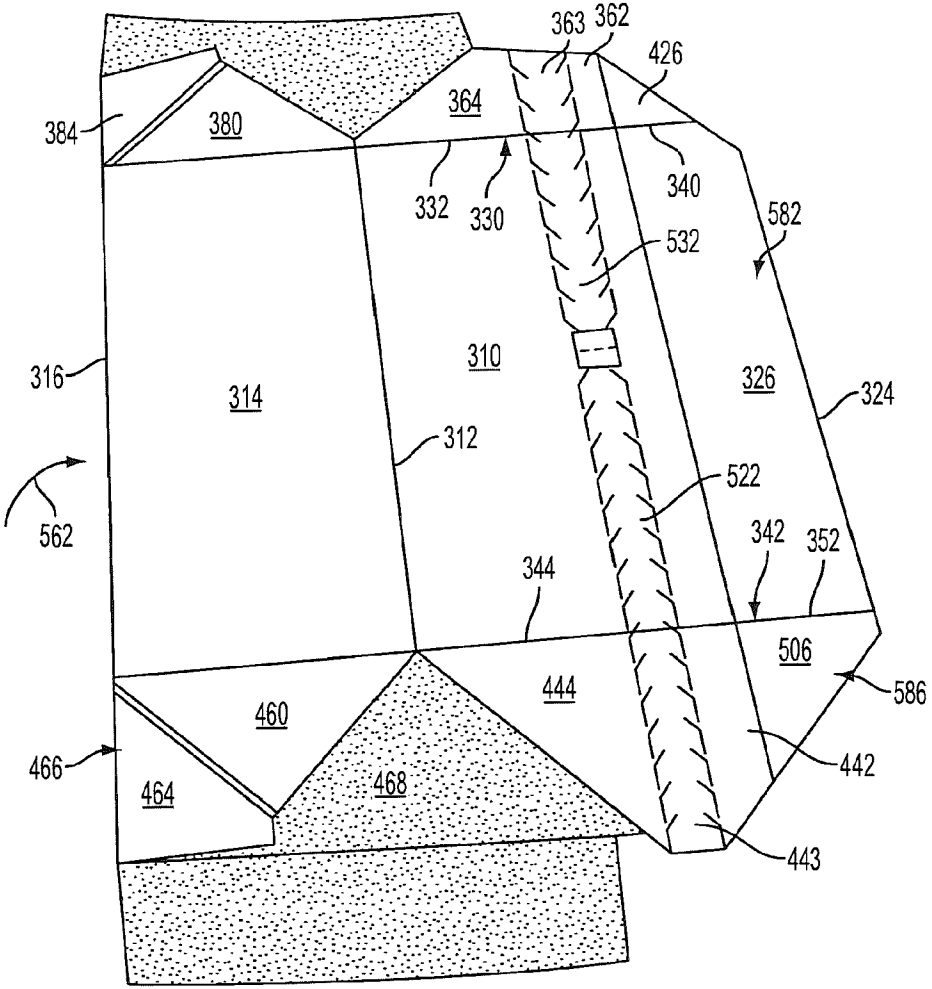

Referring to FIG. 25, the first side panel 322 and first top panel 310, and the flaps attached thereto, are folded over about the transverse fold line 316 in the direction of the arrow 562. The underside of the first top panel 310 is brought into contact with and adhered to the adhesive section 512 of the second top panel 326 by the adhesive 428 (shown in FIG. 24). The second top flaps 368, 374 and third top flaps 454, 468 connected to the first top panel 310 are respectively aligned with the adhesive sections 430 of the second top flaps 416, 420 and third top flaps 496, 500 connected to the second top panel 326. In the partially formed configuration of FIG. 25, the first top panel 310 and second top panel 326 are adhered together to form a top wall 582 of the carton 580. The overlapped and adhered first top flaps 364, 444 second top flaps 368, 374 and third top flaps 454, 468 form respective top end flaps 584, 588 at respective ends of the top wall 582. The overlapped and adhered first top flaps 364, 444 and second top flaps 368, 374 form a first portion 586, 592 of each of the top end flaps 584, 588 and the adhered third top flaps 454, 468 form a second portion 585 (FIG. 26) of the top end flaps 584, 588. The first portion 586, 592 and second portion 585 of each of the top end flaps 584, 588 are respectively foldably connected at a fold line 596 that comprises the portions of lateral fold lines 312, 324 that overlap portions of the longitudinal fold line 330.

The blank 308 is folded about the lateral fold lines 316, 312, 324 to upwardly position the first and second side panels 322 relative to the bottom panel 318 so that the top wall 388 is generally parallel to the bottom panel 318 and the blank 308 is formed into a generally open ended sleeve 594. The partially formed carton 580 or sleeve 594 has an interior space 600.

Figure 26:
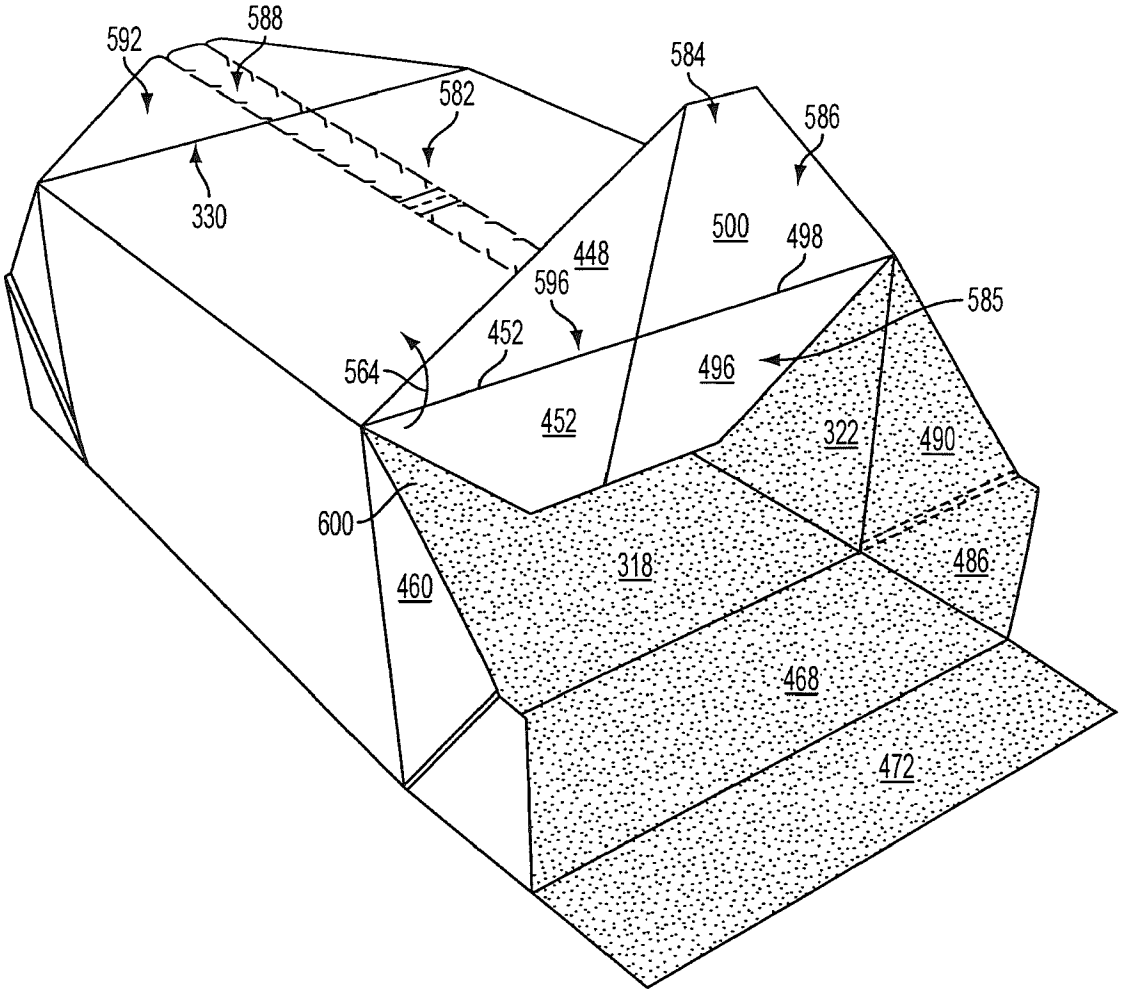

As shown in FIG. 26, the top end flaps 584, 588 may be pivoted upward in the direction of arrow 564 about fold line 596 so that the first portion 586, 592 of the top end flap is in face-to-face relation with the top wall 582 of the sleeve 594 and the second portion 585 of the top end flap 584, 588 extends outward from the top wall 582. The configuration of the sleeve 594 and top end flap 584, 588 generally is a container-loading position of the carton 580. Either or both ends of the sleeve 594 may be positioned with the top end flaps 584, 588 in the carton-loading position so that containers C may be loaded into the carton form either or both ends of the sleeve without departing from the disclosure. With the top end flap 584, 588 in the container-loading position, containers C, such as twelve-ounce beverage containers, are loaded into the interior space 600 of the open-ended sleeve 594. In the illustrated embodiment, the carton 580 is sized to accommodate twelve twelve-ounce beverage containers, but the carton may accommodate other quantities, sizes, and types of containers without departing from the disclosure.

Figure 27:
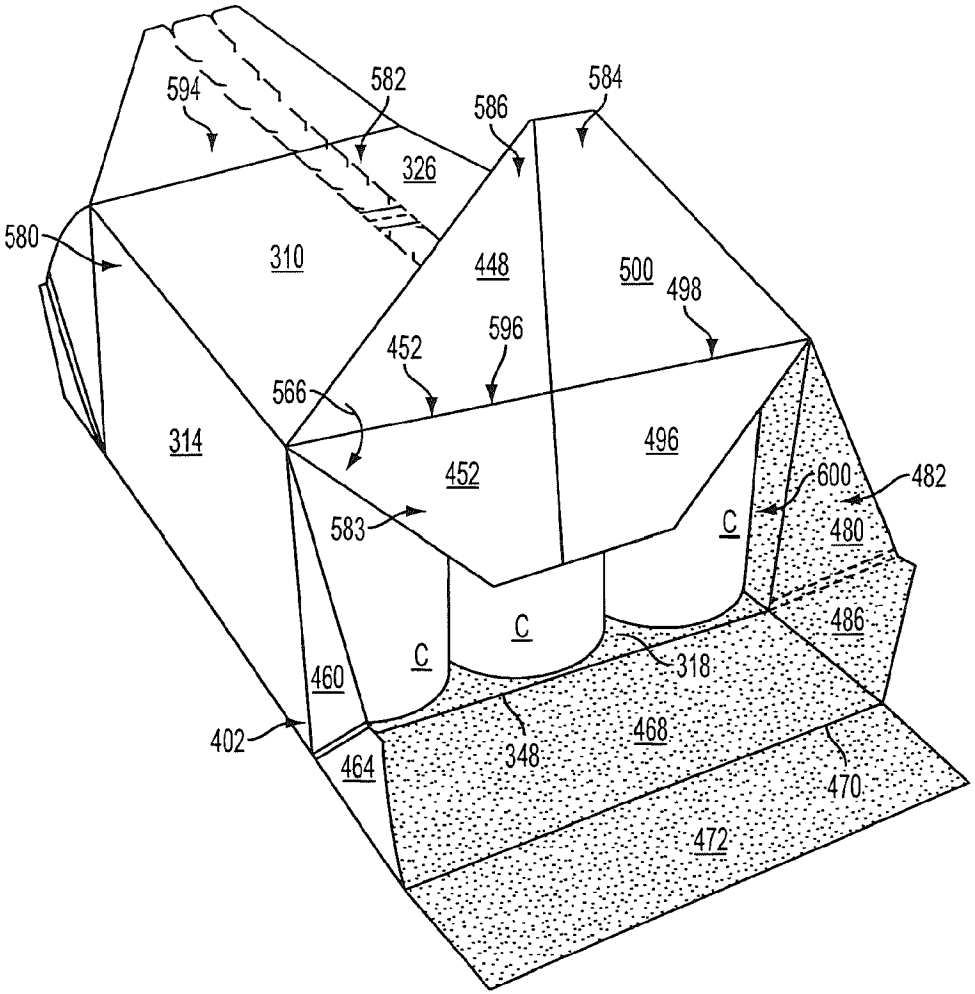

FIGS. 27 through 30 illustrate one exemplary method of closing one end of the carton 580 after the beverage containers C have been loaded. The opposite end can be closed in substantially the same manner. As shown in FIG. 27, the top end flap 584, 588 is upwardly pivoted in the direction of arrow 566 about fold line 596 so that the top end flap 584, 588 is positioned generally perpendicular relative to the top wall 582 and bottom panel 322. In the position of FIG. 27, the lower portion 585 of the top end flap 584, 588 is a container-retaining portion that retains the containers C in the interior space 600 of the sleeve 594 when the ends of the carton 580 are closed.

Figure 28:
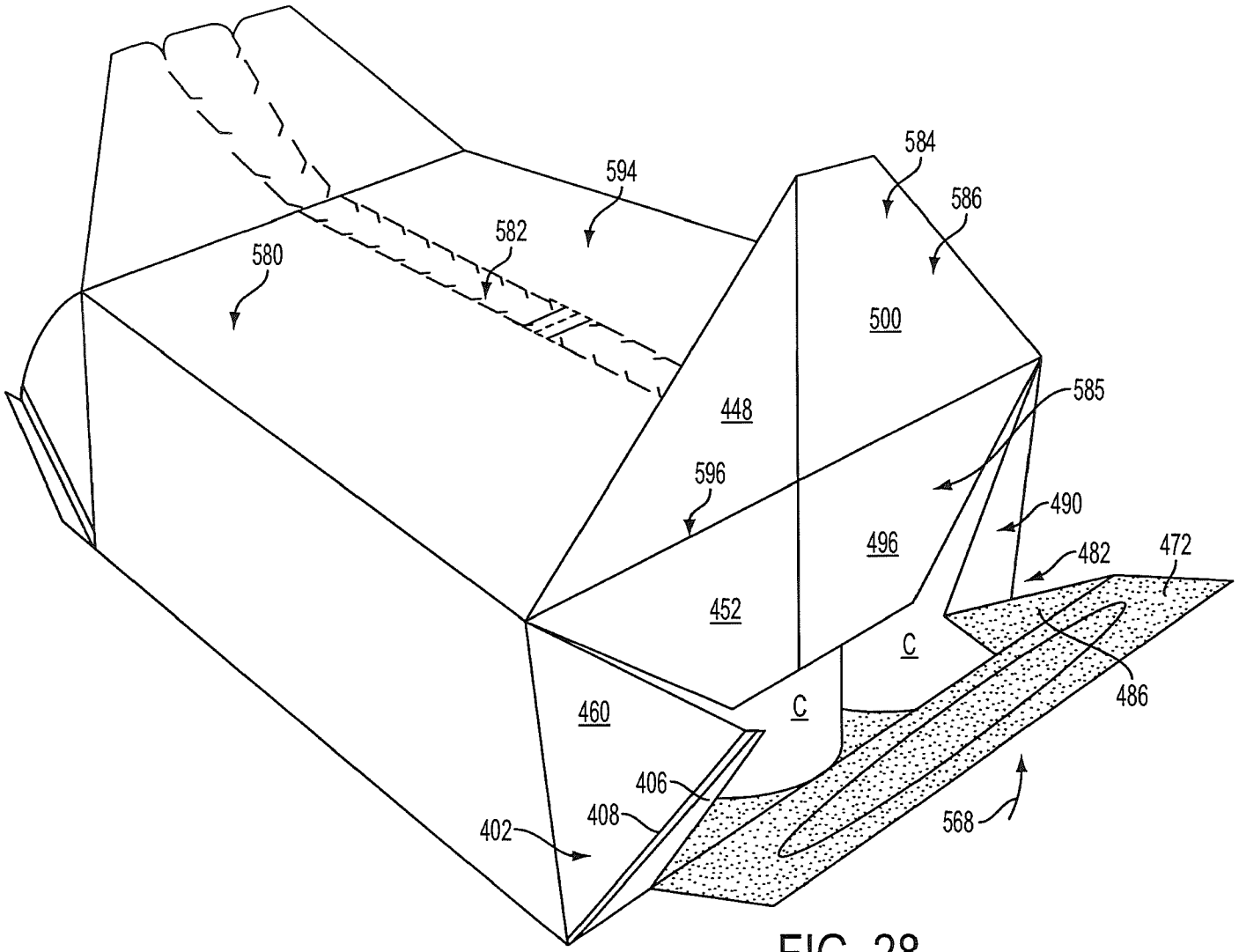
Figure 29:
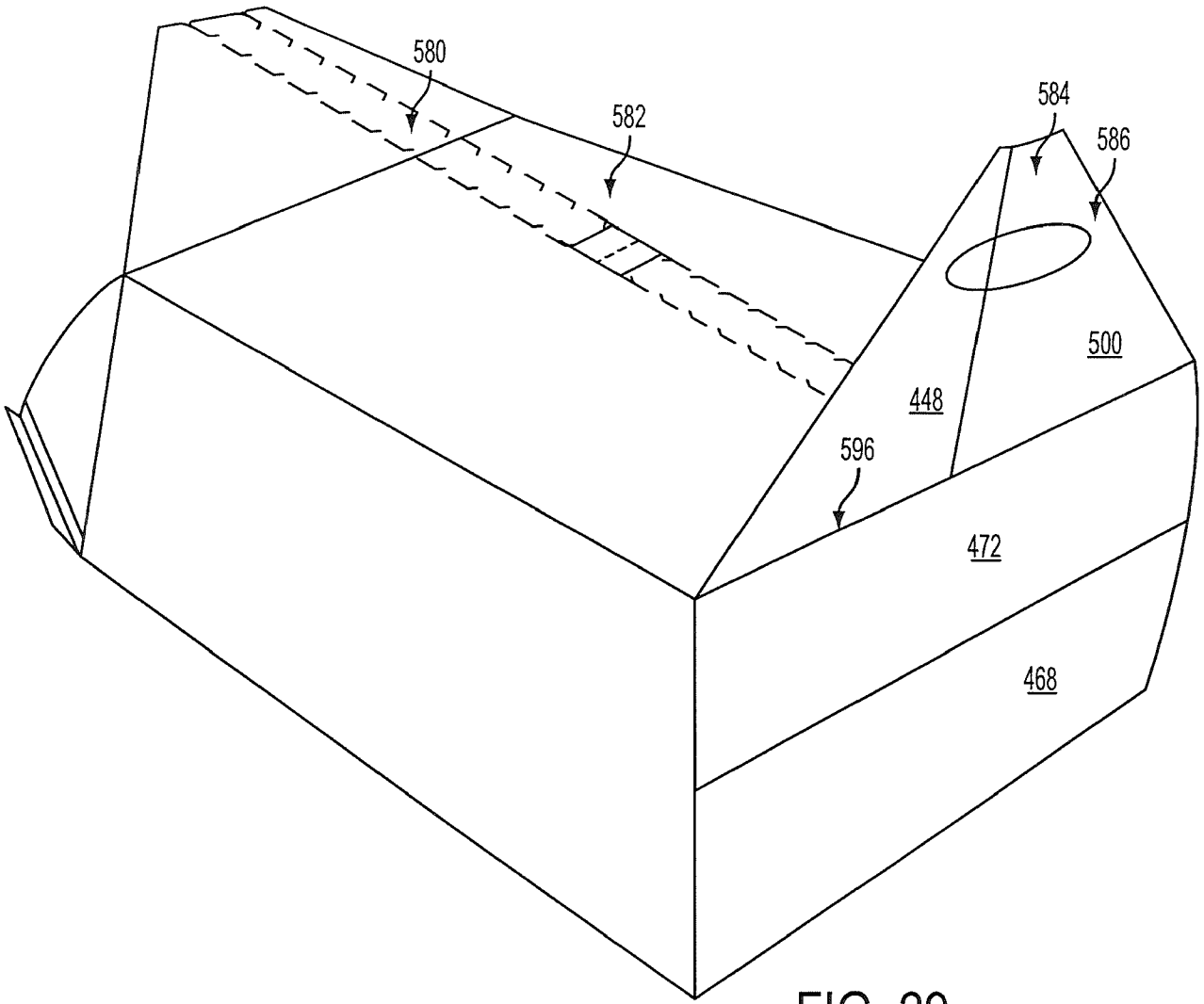

Referring to FIGS. 27-28, glue or other adhesive can be applied to the distal portion 398 of the bottom end flap 388, 468 by any suitable application process (e.g., glue gun or other suitable dispenser). The gussets 400, 402, 480, 482 are folded inwardly about the oblique fold lines 408, 488. As the gussets 400, 402, 480, 482 are folded inwardly, the bottom end flap 388, 468 folds about the longitudinal fold line 330 and moves upwardly in the direction of the arrow 568 toward the second portion 585 of the top end flap 584, 588. The interior side of the distal section 398 may be pressed against and adhered to the second portion 585 of the top end flap 584, 588 (e.g., the print side of the third top flaps 416, 496). Either of the gusset panels may be, for example, adhered together or adhered to the bottom end flap 388, 468.

Figure 30:
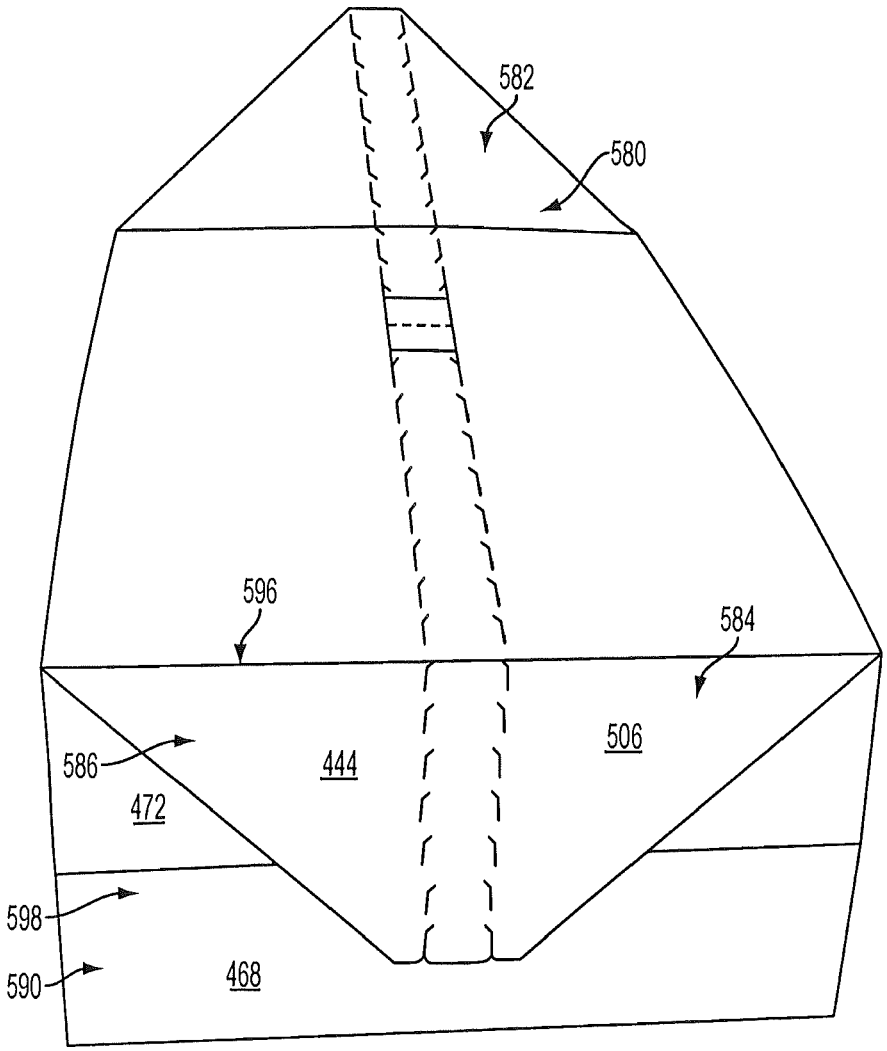
Figure 31:
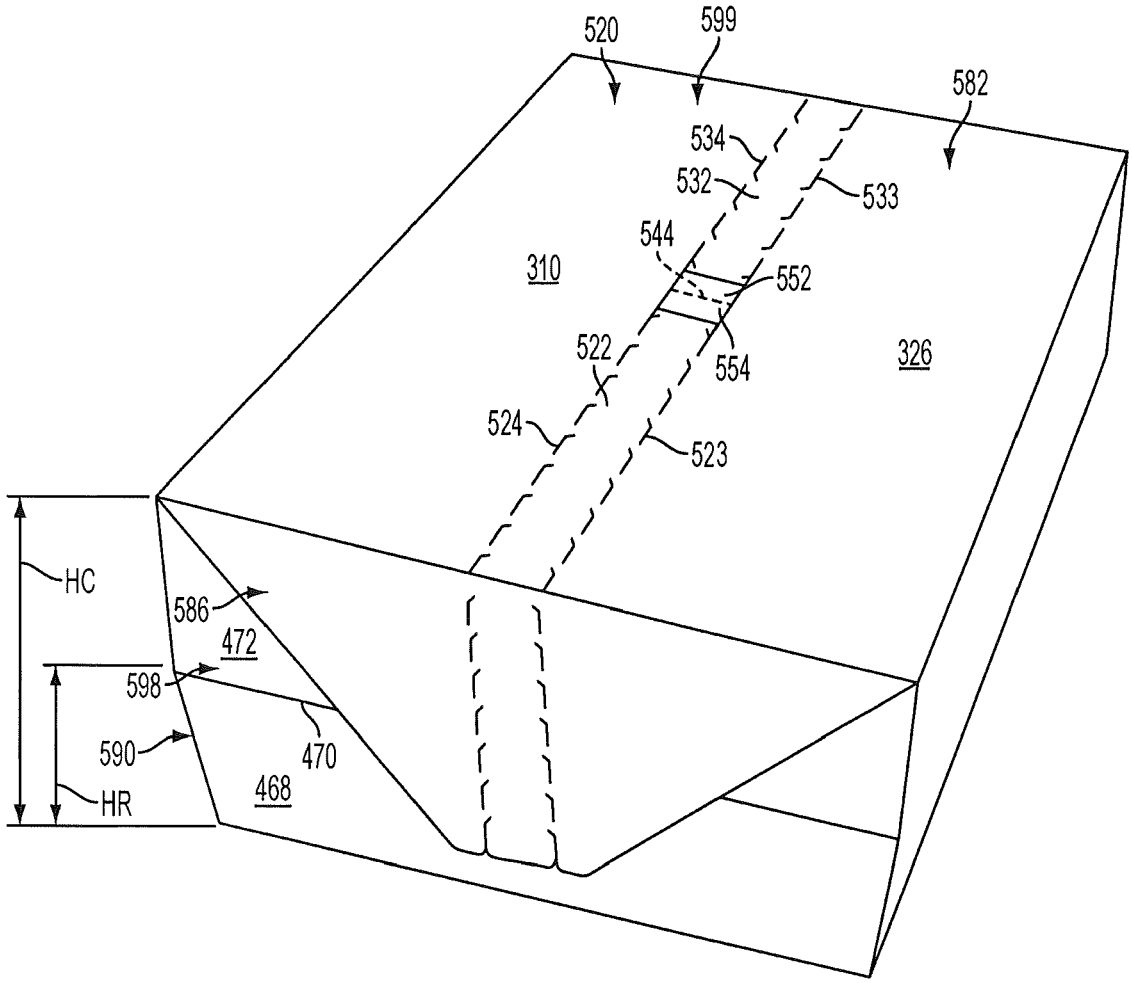

Glue or other adhesive may be applied to the first portion 586, 592 of the top end flap 584, 588 that extends upward from the raised bottom end flap 388, 468 that partially closes the end of the carton 580. The first portion 586, 592 of the top end flap 584, 588 is downwardly folded about fold line 596 so that the first portion 586, 592 is adhered to the bottom end flap 388, 468 (FIG. 30). As shown in FIG. 31, the other end of the carton 580 can be closed in a similar manner as described above. Alternatively, the end of the carton 580 can have different flap/panel arrangements and/or alternative closing steps without departing from the disclosure. The overlapped portions 586, 592, 585 of the top flap 584, 588 the flaps 388, 468, and the panels 380, 384, 406, 410, 460, 464, 486, 490 form an end panel 598 at each end of the carton.

The carton 580 may be loaded with articles at any time before fully closing the carton 580. In the illustrated embodiment, the carton 580 is loaded with twelve generally cylindrical twelve-ounce beverage containers C disposed in a 3×4×1 configuration, but the carton could be constructed to accommodate other size beverage containers in alternative configurations. The erected carton 580 is substantially parallelepipedal.

The carton 580 can be opened by breaching the top panel 402 at the breach line 544. The breach line 544 may be breached, for example, by the user pressing a hand or finger, etc. through the top panel 402 at the breach line 544. The tear strips 522, 532 may be removed by grasping the opening flaps 552 and tearing along tear lines 534 to allow the top panel 402 to open. The carton 580 can be opened to have a relatively wide top opening. This feature allows for easy access to the containers C in the carton 580. The gussets 480, 482 are generally similar in function as the gussets 480, 482 shown and described in U.S. patent application Ser. No. 11/943,915, filed Nov. 21, 2007, the entire contents of which are incorporated by reference herein for all purposes. The gussets 480, 482 may define in part an at least partially liquid-tight bottom receptacle 590 in the erected carton 580, similar to the receptacle 590 shown and described in the '915 Application. The bottom receptacle 590 may be formed from a continuous section of folded material of the blank 308. The height of the liquid-tight portion of the receptacle 590 below which there are no glued seams is generally indicated as a height $H_R$ in FIG. 31. The height $H_R$ may correspond to, for example, the height of the fold line 470 shown in FIG. 31. The height $H_R$ may be, for example, defined as a function of a height of the carton 580. For example, the bottom receptacle 590 may define a liquid-tight portion having a height $H_R$ that is at least about 10% of a height $H_c$ of the carton 280, 580. In another embodiment, the receptacle 290, 590 height $H_R$ may be at least about 20% of a height $H_c$ of the carton 280, 580. The receptacle height $H_R$ may be increased or decreased, for example, to accommodate larger or smaller anticipated liquid volumes in the carton 280, 580.

If desired, additional articles may be placed in the carton 80, 580 after opening. For example, if the containers C are beverage containers, ice may be placed over the containers C and held within the carton interior to cool the containers. As the ice melts, the receptacle 290, 590 at the bottom of the carton 280, 580 serves to retain all or a portion of the water runoff from the melting ice. The receptacle 290, 590 may also serve, for example, to house fine particulate matter that might otherwise escape through a glued seam. If one or more containers C is damaged during shipping or storage of the carton 280, 580, the bottom receptacle 290, 590 can serve to retain all or a portion of the contents of the broken container.

The blank 8, 308 can, for example, be constructed of water resistant material to any degree desired so that liquid in the bottom of the carton 280, 580 remains in the bottom receptacle 290, 590 for a selected amount of time. The carton 280, 580 can therefore be constructed so that liquid retained in the bottom receptacle 290, 590 initially remains in the carton 280, 580 at least until it reached the height $H_R$. Cartons according to the principles of the present invention may be formed from materials such as paperboard. Therefore, if exposed to water or other liquids for extended periods of time, the carton may allow for the passage of liquid through the wetted carton surfaces due to partial permeability of the carton material. In this specification, the term "liquid-tight" is generally used to define a section of a carton that is formed from a continuous section of material or of a section without any glued seams through which liquid or fine particulate matter might leak, and the term "liquid-tight" therefore encompasses cartons that may become partially water permeable over time due to prolonged exposure to water or other liquids.

In the above embodiments, the carton 280, 580 is described as accommodating twelve 12-ounce containers (cans shown) C in 3×4×1 configuration. Other arrangements of containers, packages, articles, and other items, however, can be accommodated within a carton constructed according to the principles of the present invention. For example, a carton constructed according to the principles of the present invention would also work satisfactorily if the carton were sized and shaped to hold articles in other configurations, such as 4×3×1, 3×6×1, 2×4×1, 2×5×1, etc. The dimensions of the blank 8/308 may also be altered, for example, to accommodate various container forms. For example, 16-ounce petaloid bottles may be accommodated within a carton constructed according to the principles of the present invention.

In general, the blank may be constructed from paperboard having a caliper of at least about 14, for example, so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blank may then be coated with a varnish to protect information printed on the blanks. The blank may also be coated with, for example, a moisture barrier layer, on either or both sides of the blank. The blank can also be laminated to or coated with one or more sheet-like materials at selected panels or panel sections.

The term "line" as used herein includes not only straight lines, but also other types of lines such as curved, curvilinear or angularly displaced lines.

In accordance with the exemplary embodiment of the present invention, a fold line can be any substantially linear, although not necessarily straight, form of disruption or weakening in the blanks that facilitates folding therealong. More specifically, but not for the purpose of narrowing the scope of the present invention, examples of fold lines include: score lines; crease lines; a cut or a series of cuts that extend partially into and/or completely through the material along a desired line of weakness; and various sequential and/or overlapping combinations of these exemplary features.

For purposes of the description presented herein, the term "line of disruption" can be used to generally refer to cuts, scores, creases, cut-space lines, cut-creases, cut-scores, combinations thereof, and other forms of disruption formed in the material of the blanks. A "breachable" line of disruption is a line of disruption that is intended to be breached during ordinary use or packaging of the blanks. Examples of breachable lines of disruption include cut-creases, cut-scores, cut-spaces, scores, tear lines, combinations thereof, etc.

In the present specification, a "panel" or "flap" need not be flat or otherwise planar. A "panel" or "flap" can, for example, comprise a plurality of interconnected generally flat or planar sections. The above embodiments may be described as having one or panels adhered together by glue. The term "glue" is intended to encompass all manner of adhesives commonly used to secure paperboard carton panels in place.

In the illustrated embodiments, selected fold lines are shown as including spaced cuts to facilitate folding along the lines. If the cuts are below or adjacent to the bottom receptacle portion of the carton, less than 100% cuts may be used to prevent leakage along the fold lines. Alternatively, cuts or scores may be omitted within or near the receptacle portion.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments of the present disclosure. As various changes could be made in the above construction without departing from the scope of the disclosure, it is intended that all matter contained in the above description or shown in the accompanying drawings shall be interpreted as illustrative and not in a limiting sense. Furthermore, the present disclosure covers various modifications, combinations, and alterations, etc., of the above-described embodiments that are within the scope of the claims. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A method of erecting a carton blank, the carton blank comprising:

a first side panel, a bottom panel, a second side panel foldably connected to the bottom panel at a first transverse fold line, a first top panel foldably connected to the first side panel at a second transverse fold line, a second top panel foldably connected to the second side panel, a first bottom end panel at a first end of the bottom panel, a second bottom end panel at a second end of the bottom panel, at least one first top flap foldably connected to a first end of the first top panel at a first longitudinal fold line, the at least one first top flap comprising a pair of first top flap portions connected to one another at a first oblique fold line;

at least one second top flap foldably connected to a second end of the first top panel at a second longitudinal fold line, the at least one second top flap comprising a pair of second top flap portions connected to one another at a second oblique fold line;

at least one third top flap foldably connected to a first end of the second top panel at a third longitudinal fold line, the at least one third top flap comprising a pair of third top flap portions connected to one another at a third oblique fold line, and at least one fourth top flap foldably connected to a second end of the second top panel at a fourth longitudinal fold line, the at least one fourth top flap comprising a pair of fourth top flap portions connected to one another at a fourth oblique fold line; the method comprising:

folding the at least one first top flap at the first oblique fold line, and folding the at least one second top flap at the second oblique fold line;

folding the at least one third top flap at the third oblique fold line, and folding the at least one fourth top flap at the fourth oblique fold line;

folding the first top panel with respect to the first side panel about the second transverse fold line;

folding the second side panel with respect to the bottom panel about the first transverse fold line;

folding the blank to form a tubular structure;

folding the at least one first top flap and the at least one third top flap with respect to the first top panel and the second top panel about the first longitudinal fold line and the third longitudinal fold line, respectively;

folding the first bottom end panel with respect to the bottom panel, gluing the first bottom end panel to an inner portion of the at least one first top flap and the at least one third top flap; and folding an outer portion of the at least one first top flap and the at least one third top flap about the first longitudinal fold line and the third longitudinal fold line, respectively, to overlap the first bottom end panel and to close a first end of the carton.

2. The method of claim 1, wherein gluing the blank to form a tubular structure comprises:

forming a top panel at least from the first top panel and the second top panel, adhering the first top panel to the second top panel;

adhering the at least one first top flap to the at least one third top flap; and adhering the at least one second top flap to the at least one fourth top flap.

3. The method of claim 2, wherein the carton blank further comprises:

at least one first side panel flap foldably connected to a first end of the first side panel at a fifth longitudinal fold line;

at least one second side panel flap foldably connected to a second end of the first side panel at a sixth longitudinal fold line;

at least one third side panel flap foldably connected to a first end of the second side panel at a seventh longitudinal fold line;

at least one fourth side panel flap foldably connected to a second end of the second side panel at an eighth longitudinal fold line;

wherein the first bottom end panel is foldably connected to the bottom panel along a ninth longitudinal fold line; and wherein the second bottom end panel is foldably connected to the bottom panel along a tenth longitudinal fold line.

4. The method of claim 3, further comprising:

folding the at least one first side panel flap with respect to the first side panel about the fifth longitudinal fold line; and folding the at least one third side panel flap with respect to the second side panel about the seventh longitudinal fold line.

5. The method of claim 4, wherein:

the at least one first side panel flap comprises a pair of first side panel flap portions connected to one another at a fifth oblique fold line;

the at least one third side panel flap comprises a pair of third side panel flap portions connected to one another at a sixth oblique fold line;

the folding of the at least one first side panel flap with respect to the first side panel about the fifth longitudinal fold line comprises folding one of the pair of first side panel flap portions about the fifth oblique fold line; and the folding of the at least one third side panel flap with respect to the second side panel about the seventh longitudinal fold line comprises folding one of the pair of third side panel flap portions about the sixth oblique fold line.

6. The method of claim 5, further comprising:

at least partially closing a second end of the tubular structure.

7. The method of claim 2, wherein, after the folding of the at least one first top flap and the at least third top flap with respect to the top panel about the first longitudinal fold line and the third longitudinal fold line, respectively, the method further comprises:

loading the tubular structure with a plurality of containers.

8. A method of erecting a carton, the method comprising:

obtaining a blank comprising a plurality of panels comprising a bottom panel, a first side panel foldably connected to the bottom panel, a second side panel foldably connected to the bottom panel, a first top panel foldably connected to the first side panel, and a second top panel foldably connected to the second side panel;

a plurality of top flaps comprising a first top flap foldably connected to the first top panel at a first longitudinal fold line and a second top flap foldably connected to the second top panel at a second longitudinal fold line, the first top flap comprising a pair of first top flap portions connected to one another at a first oblique fold line the second top flap comprising a pair of second top flap portions connected to one another at a second oblique fold line; and a bottom end panel foldably connected to an end of the bottom panel;

folding the first top flap at the first oblique fold line, and folding the second top flap at the second oblique fold line;

forming a top panel by at least partially overlapping the first top panel and the second top panel, and forming a top end flap by at least partially overlapping the first top flap and the second top flap;

folding the plurality of panels to form a tubular structure; and at least partially closing a first end of the tubular structure by folding the top end flap about the first longitudinal fold line and the second longitudinal fold line, folding the bottom end panel to overlap at least an inner portion of the top end flap, and folding at least an outer portion of the top end flap to overlap the bottom end panel.

9. The method of claim 8, wherein the first top flap further comprises a first tab foldably connected to a first top flap portion of the pair of first top flap portions, the second top flap further comprises a second tab foldably connected to a second top flap portion of the pair of second top flap portions, and the inner portion of the top end flap comprises at least the first tab and the second tab.

10. The method of claim 9, wherein the outer portion of the top end flap comprises at least the pair of first top flap portions and the pair of second top flap portions.

11. The method of claim 9, wherein the folding the first top flap at the first oblique fold line comprises disposing the first tab to be overlapped by the first top panel, the folding the second top flap at the second oblique fold line comprises disposing the second tab to be overlapped by the second top panel, and the method further comprises, prior to the at least partially closing the first end, folding the top end flap along the first longitudinal fold line and the second longitudinal fold line so that the inner portion of the top end flap pivots away from the top panel and the outer portion of the top end flap overlaps the top panel.

12. The method of claim 11, further comprising loading a plurality of containers into the tubular structure after the folding the top end flap along the first longitudinal fold line and the second longitudinal fold line so that the inner portion of the top end flap pivots away from the top panel, and prior to the at least partially closing the first end.

* * * * *